US010012920B2

(12) United States Patent
Shibata et al.

(10) Patent No.: US 10,012,920 B2
(45) Date of Patent: Jul. 3, 2018

(54) TONER AND METHOD OF PRODUCING TONER

(71) Applicant: CANON KABUSHIKI KAISHA, Tokyo (JP)

(72) Inventors: Takaho Shibata, Tokyo (JP); Hayato Ida, Toride (JP); Junichi Tamura, Toride (JP); Yuya Chimoto, Funabashi (JP); Ryuji Murayama, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/527,191

(22) PCT Filed: Dec. 8, 2015

(86) PCT No.: PCT/JP2015/084869
§ 371 (c)(1),
(2) Date: May 16, 2017

(87) PCT Pub. No.: WO2016/093365
PCT Pub. Date: Jun. 16, 2016

(65) Prior Publication Data

US 2017/0329245 A1 Nov. 16, 2017

(30) Foreign Application Priority Data

Dec. 9, 2014 (JP) ..... 2014-249319
Nov. 30, 2015 (JP) ..... 2015-233845

(51) Int. Cl.
*G03G 9/08* (2006.01)
*G03G 9/087* (2006.01)

(52) U.S. Cl.
CPC ..... *G03G 9/08755* (2013.01); *G03G 9/0804* (2013.01); *G03G 9/0819* (2013.01);
(Continued)

(58) Field of Classification Search
CPC ..... G03G 9/08755; G03G 9/08797; G03G 9/0819; G03G 9/0821; G03G 9/0825; G03G 9/0827
(Continued)

(56) References Cited

U.S. PATENT DOCUMENTS 3,853,778 A 12/1974 Buckley et al.
6,890,695 B2 5/2005 Shirai et al.
(Continued)

FOREIGN PATENT DOCUMENTS

JP S56-013943 B2 4/1981
JP S62-039428 B2 8/1987
(Continued)

OTHER PUBLICATIONS

Basic Coating Science, pp. 54-57 (1986).
Harazaki, Y., "Basic Coating Science", (Table 3-9) pp. 55-56, (Sep. 15, 1977), First Edition.

*Primary Examiner* — Mark A Chapman
(74) *Attorney, Agent, or Firm* — Fitzpatrick Cella Harper and Scinto

(57) ABSTRACT

An object of the present invention is to provide a toner that exhibits high levels of the low-temperature fixability, storability, and charging performance all at the same time. The toner of the present invention is a toner that has a toner particle comprising a crystalline resin and an amorphous resin, the toner being characterized in that the toner satisfies $0.00 \leq (Wt2/Wt1) \leq 0.50$; the toner particle has a matrix-domain structure in which domains of the crystalline resin are present in a matrix of the amorphous resin; at least 90 number % of the crystalline resin domains are domains with a diameter from 0.05 μm to 0.50 μm; and SF1 for the crystalline resin domains is from 100 to 130.

4 Claims, 1 Drawing Sheet

(52) U.S. Cl.
CPC ..... *G03G 9/0821* (2013.01); *G03G 9/0825* (2013.01); *G03G 9/0827* (2013.01); *G03G 9/08795* (2013.01); *G03G 9/08797* (2013.01)

(58) Field of Classification Search
USPC ..... 430/109.4, 110.1, 111.4
See application file for complete search history.

(56) References Cited

U.S. PATENT DOCUMENTS

| | | | |
|---|---|---|---|
| 7,833,687 | B2 | 11/2010 | Kato et al. |
| 8,697,327 | B2 | 4/2014 | Shibata et al. |
| 9,057,970 | B2 | 6/2015 | Ida et al. |
| 9,348,247 | B2 | 5/2016 | Ida et al. |
| 9,540,483 | B2 | 1/2017 | Ida et al. |
| 9,696,644 | B2 | 7/2017 | Ida et al. |
| 2013/0108955 | A1 | 5/2013 | Shibata et al. |
| 2014/0342283 | A1 | 11/2014 | Yamamoto et al. |
| 2015/0099227 | A1 | 4/2015 | Ida et al. |
| 2015/0253686 | A1* | 9/2015 | Miyakoshi ..... G03G 9/08755 430/109.4 |

FOREIGN PATENT DOCUMENTS

| | | | |
|---|---|---|---|
| JP | H04-120554 | A | 4/1992 |
| JP | 2003-050478 | A | 2/2003 |
| JP | 2002-287426 | A | 10/2003 |
| JP | 2006-065077 | A | 3/2006 |
| JP | 2011-145587 | A | 7/2011 |
| JP | 2012-022331 | A | 2/2012 |
| JP | 2012-063534 | A | 3/2012 |

* cited by examiner

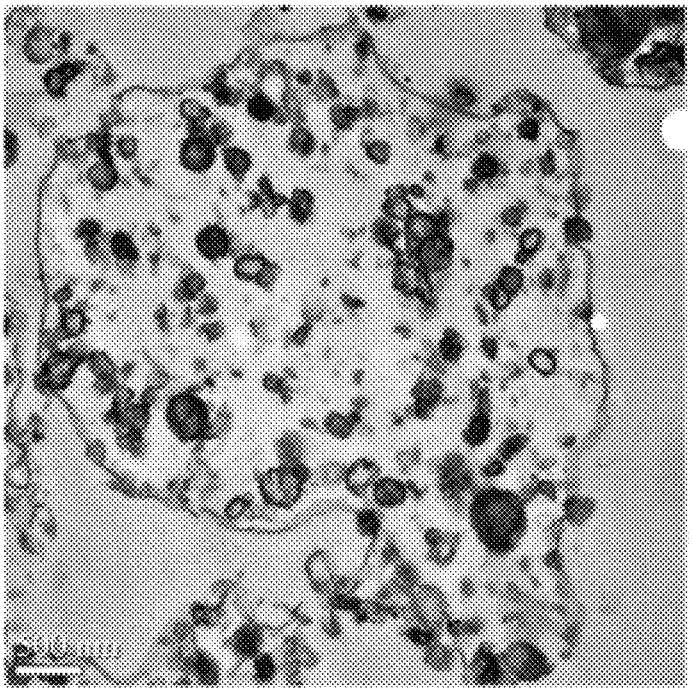

TONER AND METHOD OF PRODUCING TONER

TECHNICAL FIELD

The present invention relates to a toner for developing electrostatic latent images, for use in, for example, electrophotographic methods and electrostatic recording methods. The present invention also relates to a method of producing this toner.

BACKGROUND ART

Accompanying increasing demands in recent years for greater energy savings during image formation, efforts have been made to lower the toner fixation temperature. Additional reductions in the fixation temperature achieved through the use of low softening temperature polyesters have been proposed as one approach here.

However, due to the low softening temperature, under conditions of quiescence, e.g., during storage or transport, the toner can undergo melt agglomeration and blocking can be produced.

As a means for balancing the blocking resistance with the low-temperature fixability, patent Literature 1 to 3 teach art that uses a crystalline resin that has a sharp melt property, i.e., its viscosity undergoes a large decline when the melting point is exceeded.

However, a major problem occurs when crystalline polyester, which is a crystalline resin, is used by itself as the binder resin, i.e., due to the low electrical resistance of crystalline polyesters, the charge on the toner gradually leaks away after triboelectric charging.

Patent Literature 4 describes a toner that has a reduced amount of addition of crystalline polyester and that uses a mixture of a crystalline polyester and an amorphous resin readily compatible therewith.

However, this is a toner that contains an amorphous resin along with crystalline polyester as the binder resin, and the following problem can occur when readily compatible resins are combined with each other.

When, during toner production, a step of melting by heating to at least the melting point of the crystalline polyester is carried out, or a step of dissolving the crystalline polyester using an organic solvent is carried out, the amorphous resin and the crystalline polyester remain present miscibilized in the toner. As a result, plasticization of the amorphous resin (that is, a lowering of the glass transition temperature) is induced, and as a consequence, while the sharp melt property is excellent, the charging performance and heat-resistant storability are inadequate and deterioration may occur.

In the case, on the other hand, of a toner that uses a mixture of crystalline polyester and an amorphous resin poorly compatible therewith, the resins are poorly compatible with each other and the following problem can be produced.

During toner production, after the step of melting by heating to at least the melting point of the crystalline polyester has been carried out, or after the step of dissolving the crystalline polyester using an organic solvent has been carried out, the amorphous resin and the crystalline polyester are phase-separated from each other and a matrix-domain structure is spontaneously formed in correspondence to the compatibility of the resins. As a result, plasticization of the amorphous resin (that is, a lowering of the glass transition temperature) is not induced and, while the charging performance and heat-resistant storability are excellent, the low-temperature fixability is inadequate due to the low compatibility.

As a method for inducing phase separation of a mutually dissolved crystalline polyester and amorphous resin when readily compatible resins have been combined with each other, Patent Literature 5 teaches a method in which phase separation is induced through crystallization of the crystalline polyester achieved by providing an annealing step in which crystallization is promoted by heat-treating the toner at a temperature near the melting point but not above the melting point of the crystalline polyester.

Patent Literature 6 describes the following method as a method for suppressing compatibilization during toner production: the crystalline polyester is recrystallized by dissolution in a solvent and cooling; the crystalline polyester is subsequently mechanically pulverized and dispersed in a solvent; a toner constituent component containing an amorphous resin is then dissolved or dispersed in the solvent; and toner is obtained through a granulating step.

Patent Literature 7 describes a toner in which the low-temperature fixability is made to coexist in good balance with the storability by regulating the domain diameter of the crystalline polyester present in the toner.

Patent Literature 8 describes a toner that exhibits an excellent low-temperature fixability and an excellent releasability during fixing, which is brought about by regulating the aspect ratio of the domains formed by the crystalline resin incorporated in the toner.

CITATION LIST

Patent Literature

[PTL 1] Japanese Examined Patent Publication No. S56-13943

[PTL 2] Japanese Examined Patent Publication No. S62-39428

[PTL 3] Japanese Patent Application Laid-open No. H4-120554

[PTL 4] Japanese Patent Application Laid-open No. 2003-50478

[PTL 5] Japanese Patent Application Laid-open No. 2006-65077

[PTL 6] Japanese Patent Application Laid-open No. 2012-63534

[PTL 7] Japanese Patent Application Laid-open No. 2002-287426

[PTL 8] Japanese Patent Application Laid-open No. 2011-145587

SUMMARY OF INVENTION

Technical Problem

As described in Patent Literature 5, when an annealing step is provided in which a heat treatment is carried out at a temperature near the melting point of the crystalline polyester but not above this melting point, crystallization of the crystalline polyester is promoted and phase separation from the amorphous resin is induced.

However, once a crystalline polyester has undergone miscibilization and blending into an amorphous resin, the treatment in the annealing step must be carried out for a long period of time or under high temperature conditions in order to bring about a thorough phase separation by heat treatment of the crystalline polyester resin.

In this case, the promotion of crystallization is accompanied by growth of the crystalline polyester domains into large needle-shaped crystals that have high aspect ratios. As a result, crystalline polyester domains, which are a low resistance component, readily become exposed at the toner surface and the domains, which have low resistance values, also come into contact with one another, and conductive pathways, which form charge dissipation pathways, are readily formed and the charging performance is inadequate as a consequence.

As described in Patent Literature 6, in a toner production method in which the crystalline polyester is recrystallized and subsequently mechanically pulverized, the crystalline polyester and amorphous resin undergo phase separation from each other and due to this the low-temperature fixability can coexist with the storability.

However, it is difficult to control the diameter and shape of the crystalline polyester domains and coarse domains greater than 0.5 μm are produced. In addition, the needle-shaped crystals formed during recrystallization are crushed, and because of this high aspect ratio domains are readily produced and the crystalline polyester domains, which are a low resistance component, are then readily exposed at the toner surface. The charging performance is inadequate as a result.

As described in Patent Literature 7, when the compatibility has been controlled through the chemical structures of the crystalline resin and amorphous resin and the domain diameter of the crystalline polyester has been regulated, it appears that an excellent storability and an excellent charging performance occur when the compatibility is lowered to the degree that a phase-separated structure is formed as described above.

However, the low-temperature fixability is unsatisfactory due to the low compatibility between the resins.

On the other hand, in the case of a high-compatibility combination, as described in Patent Literature 7 the desired domains cannot be formed because compatibilization ends up being brought about during melt kneading, and the storability and charging performance are then inadequate.

As described in Patent Literature 8, it appears that the shape of the domains of the crystalline polyester resin can be controlled when, after microparticles of the crystalline polyester resin have been formed, a seed polymerization is performed using a radically polymerizable monomer.

However, the low-temperature fixability is inadequate due to the low compatibility between the crystalline polyester resin, which is the domain, and the amorphous resin obtained by radical polymerization, which is the matrix.

An object of the present invention is to provide a toner that exhibits high levels for the low-temperature fixability, storability, and charging performance all at the same time. A further object of the present invention is to provide a method of producing this toner.

Solution to Problem

As a result of intensive investigations, the present inventors discovered that the following considerations are crucial:

with regard to the low-temperature fixability, that the crystalline resin and amorphous resin are a combination in which these are highly compatible with each other;

with regard to the storability, that the crystalline resin and amorphous resin form a phase-separated structure in the toner; and with regard to the charging performance, that the crystalline resin and amorphous resin form a phase-separated structure in the toner and that the particle diameter and shape of the domains of the crystalline resin, which is a low resistance component, are controlled.

The following are thus crucial: that the toner particle has a matrix-domain structure in which domains of a crystalline resin, which is a plasticizer and also a low resistance component, are present in a matrix of an amorphous resin that is a high resistance component; also, that the crystalline resin domains are microscopic and have a spherical shape.

High levels for the low-temperature fixability, storability, and charging performance can be exhibited all at the same time by causing a crystalline resin and an amorphous resin compatible with this crystalline resin to undergo microphase separation.

Substantial effects were seen for these in particular when the crystalline resin was incorporated in large amounts in order for the low-temperature fixability to be exhibited at a high level.

That is, the present invention relates to a toner having a toner particle that contains a crystalline resin and an amorphous resin, the toner being characterized in that the toner satisfies the following formula (1); the toner particle has a matrix-domain structure in which domains of the crystalline resin are present in a matrix of the amorphous resin; at least 90 number % of the crystalline resin domains are domains with a diameter from 0.05 μm to 0.50 μm; and SF1 for the crystalline resin domains, which is calculated with the following formula (2), is from 100 to 130:

$$0.00 \leq (Wt2/Wt1) \leq 0.50 \quad \text{formula (1)}$$

$$SF1 = (ML^2/A) \times (\pi/4) \times 100 \quad \text{formula (2)}$$

[in formula (1), Wt1 represents heat of fusion (J/g) originating with the crystalline resin during a first temperature ramp up in measurement on the toner using a differential scanning calorimeter (DSC), and Wt2 represents heat of fusion (J/g) originating with the crystalline resin during a second temperature ramp up in measurement on the toner using a differential scanning calorimeter (DSC)]

[in formula (2), ML represents the absolute maximum length of the crystalline resin domains and A represents a projected area of the crystalline resin domains].

The present invention additionally relates to a method of producing toner that produces the aforementioned toner, wherein the toner production method characteristically has an aggregation step of obtaining aggregate particles by mixing an amorphous resin microparticle dispersion in which microparticles of the amorphous resin are dispersed, with a crystalline resin microparticle dispersion in which microparticles of the crystalline resin are dispersed, and carrying out an aggregation in which microparticles including the amorphous resin microparticles and the crystalline resin microparticles are aggregated; and a fusion step of carrying out a fusion treatment on the aggregate particles by adding, at a fusion treatment temperature set to a temperature that is not larger than the onset temperature of the crystal melting peak of the crystalline resin as measured with a differential scanning calorimeter (DSC), an organic solvent that at the fusion treatment temperature is a good solvent for the amorphous resin and a poor solvent for the crystalline resin.

Advantageous Effects of Invention

The present invention provides a toner that exhibits high levels for the low-temperature fixability, storability, and charging performance all at the same time. The present invention also provides a method of producing this toner.

BRIEF DESCRIPTION OF DRAWINGS

The FIGURE is a transmission electron micrograph of a cross section of toner 1 (photograph in lieu of drawing).

DESCRIPTION OF EMBODIMENTS

The toner of the present invention is a toner that has a toner particle that contains a crystalline resin and an amorphous resin, and is characterized in that the toner satisfies the following formula (1); the toner particle has a matrix-domain structure in which domains of the crystalline resin are present in a matrix of the amorphous resin; at least 90 number % of the crystalline resin domains are domains with a diameter from 0.05 μm to 0.50 μm; and SF1 for the crystalline resin domains, which is calculated with the following formula (2), is from 100 to 130

$$0.00 \leq (Wt2/Wt1) \leq 0.50 \quad \text{formula (1)}$$

$$SF1 = (ML^2/A) \times (\pi/4) \times 100 \quad \text{formula (2)}$$

[in formula (1), Wt1 represents the heat of fusion (J/g) originating with the crystalline resin during a first temperature ramp up in measurement on the toner using a differential scanning calorimeter (DSC), and Wt2 represents the heat of fusion (J/g) originating with the crystalline resin during a second temperature ramp up in measurement on the toner using a differential scanning calorimeter (DSC)]

[in formula (2), ML represents the absolute maximum length of the crystalline resin domains and A represents the projected area of the crystalline resin domains].

The toner of the present invention is a toner that has a toner particle that contains a crystalline resin and an amorphous resin wherein the amorphous resin and crystalline resin are a combination in which these are highly compatible with each other.

In addition, the toner particle present in the toner of the present invention has a matrix-domain structure in which domains of the crystalline resin are present in a matrix of the amorphous resin.

Moreover, at least 90 number % of the crystalline resin domains are domains that have a diameter from 0.05 μm to 0.50 μm. The crystalline resin domains have a spherical shape.

As described above, the toner of the present invention exhibits an excellent low-temperature fixability because the amorphous resin and crystalline resin are a highly compatible combination.

However, an excellent storability is provided because the amorphous resin and crystalline resin are not mutually dissolved in the toner particle and form a matrix-domain structure and are phase-separated.

In conventional toners, the crystalline resin, which is a low resistance component, forms needle-shaped crystals—for example, by an annealing treatment—in an amorphous resin that is highly compatible with the crystalline resin. Unlike the domains of these needle-shaped crystals with their high aspect ratios, in the toner of the present invention the crystalline resin domains, which are a low resistance component, do not come into contact with each other in the toner, which suppresses the formation of the conductive pathways that are a cause of low resistance and thus results in an excellent charging performance.

A significant difference emerges for these behaviors when the toner contains at least 10 mass % of the crystalline resin in pursuit of an even higher level for the low-temperature fixability.

At least 90 number % of the crystalline resin domains in the toner of the present invention have a diameter from 0.05 μm to 0.50 μm and preferably have a diameter from 0.05 μm to 0.30 μm.

Smaller diameters serve to increase the interface with the amorphous resin matrix and as a consequence provide a larger plasticization effect during fixing. When 90 number % or more of the crystalline resin domains have a diameter in excess of 0.50 μm, the crystalline resin domains are then readily exposed at the toner surface and the charging performance is reduced.

On the other hand, the SF1 of the crystalline resin domains, which is calculated using formula (2) below, is from 100 to 130 and preferably from 100 to 120

$$SF1 = (ML^2/A) \times (\pi/4) \times 100 \quad \text{formula (2)}$$

[in formula (2), ML represents the absolute maximum length of the crystalline resin domains and A represents the projected area of the crystalline resin domains].

The domains assume a spherical shape as SF1 approaches 100. The charging performance improves as SF1 approaches 100 since it is then more difficult for low resistance component-to-low resistance component contact to occur in the toner.

The diameter and SF1 of the crystalline resin domains are measured and calculated through observation of the toner cross section using a transmission electron microscope (TEM). The details are provided in the following (the case is described in which release agent, which is added on an optional basis, is present).

(1) The toner is thoroughly dispersed in a normal temperature-curable epoxy resin and the curing reaction of the epoxy resin is carried out by standing for at least one day in an atmosphere with a temperature of 40° C. to obtain a cured material in which the toner is embedded.

(2) A cross section of the cured material is exposed using a microtome equipped with a diamond blade, and the cured material with the exposed cross section is immersed for 3 hours in an organic solvent (hexane) that dissolves only the release agent in order to dissolve only the release agent domains.

(3) After this, the cured material is dried for at least one day in an atmosphere with a temperature of 40° C.; ultrathin sections are sliced off; the obtained ultrathin sections are stained with ruthenium tetroxide or osmium tetroxide; and, using a transmission electron microscope (TEM), a photograph is taken at an amplification at which the cross section of one toner particle is present in the visual field (approximately 10,000×). By staining with ruthenium tetroxide and osmium tetroxide, components in the toner that have different degrees of crystallinity are stained with the generation of contrast, and as a result the crystalline resin domains and/or release agent domains present in the toner can be identified by observation with a transmission electron microscope. Since, as noted above, the release agent domains dissolve in the hexane, the release agent domain regions form voids in the obtained TEM image and only the crystalline resin domains are stained. In those instances in which characteristic elements are present in the release agent or crystalline resin, identification can also be carried out, without having to perform the separation process, by an x-ray-based elemental analysis such as EDAX.

(4) From among the obtained toner cross section images, 20 are selected in which the long diameter of the toner cross section is 0.9-fold to 1.2-fold of the volume-average particle diameter of the toner. The selected images were measured using an image analyzer (Luzex AP from Nireco Corporation) and the phase-separation structure of the amorphous resin and crystalline resin and the domain shape and domain diameter of the crystalline resin were analyzed.

The domain diameter (diameter) of the crystalline resin is calculated using the following formula.

$$\text{domain diameter (diameter)}=2\times(A/\pi)^{1/2}$$

[A represents the projected area of the domains]

With regard to the domain shape, the shape factor SF1 of the crystalline resin domains is calculated using the following formula $$SF1=(ML^2/A)\times(\pi/4)\times 100$$

[where, ML represents the absolute maximum length of the crystalline resin domains and A represents the projected area of the crystalline resin domains].

Here, (1) the number of domains recognized as crystalline resin domains is counted in one of the selected images (a1).

(2) The domain diameter (diameter) is calculated for all of the domains recognized as crystalline resin domains in the one selected image, and the number of domains corresponding to a diameter from 0.05 μm to 0.50 μm (or a diameter from 0.05 μm to 0.30 μm) is counted (b1).

(3) (b1/a1)×100 is evaluated.

(4) Since there are 20 selected images, if (b1/a1)×100 is at least 90 for all 20, it is then established that at least 90 number % of the crystalline resin domains have a diameter from 0.05 μm to 0.50 μm (or a diameter from 0.05 μm to 0.30 μm).

Otherwise, (1) the number of domains recognized as crystalline resin domains is counted in one of the selected images (a1).

(2) The absolute maximum length and the projected area are determined for all of the domains recognized as crystalline resin domains in the one selected image; SF1 is calculated for each using the formula given above; and the average value of SF1 for the domains in the one selected image is determined (SF1a1).

(3) (1) and (2) are performed for all 20 of the selected images and the average value of SF1 for all the domains recognized as crystalline resin domains is calculated ((a1× SF1a1)+(b1× SF1b1)+(c1× SF1c1)+ . . . (t1× SF1t1)/(a1+ b1+c1+ . . . +t1) to give the SF1 of the crystalline resin domains.

The volume-average particle diameter of the toner is measured in the present invention by particle size distribution analysis using the Coulter method. The volume-average particle diameter of the toner particles and the aggregate particles is also measured by this measurement method.

A Coulter Multisizer III (Beckman Coulter, Inc.) is used as the measurement instrument, and the measurement is performed in accordance with the operating manual provided with this instrument.

The electrolyte solution may be an approximately 1% aqueous sodium chloride solution that uses first-grade sodium chloride, or ISOTON-II (Coulter Scientific Japan, Ltd.) may also be used.

The specific measurement method is as follows.

0.1 mL to 5 mL of a surfactant (alkylbenzenesulfonate salt) is added as a dispersing agent to 100 mL to 150 mL of the aforementioned electrolyte solution. 2 mg to 20 mg of the measurement sample (toner) is added to the electrolyte solution containing this dispersing agent.

Using an ultrasound disperser, a dispersing treatment is carried out for 1 minute to 3 minutes on the electrolyte solution containing the suspended sample. The volume of the toner having a particle diameter of at least 2.00 μm is measured on the obtained dispersion-treated solution using the aforementioned measurement instrument that has been fitted with a 100-μm aperture tube as the aperture, and the volume distribution of the toner is calculated. The volume-average particle diameter (the central value for each channel is used as the representative value for each channel) of the toner is determined from this.

The following 13 channels are used for these channels: from at least 2.00 μm to less than 2.52 μm; from at least 2.52 μm to less than 3.17 μm; from at least 3.17 μm to less than 4.00 μm; from at least 4.00 m to less than 5.04 μm; from at least 5.04 μm to less than 6.35 μm; from at least 6.35 μm to less than 8.00 μm; from at least 8.00 μm to less than 10.08 μm; from at least 10.08 μm to less than 12.70 μm; from at least 12.70 μm to less than 16.00 μm; from at least 16.00 μm to less than 20.20 μm; from at least 20.20 μm to less than 25.40 μm; from at least 25.40 μm to less than 32.00 μm; and from at least 32.00 μm to less than 40.30 μm.

The amorphous resin and crystalline resin in the present invention are a combination with a high compatibility therebetween. The toner of the present invention satisfies the following formula (1) when the amorphous resin and crystalline resin are a combination with a high compatibility therebetween.

$$0.00\leq(Wt2/Wt1)\leq 0.50 \qquad \text{formula (1)}$$

[where, Wt1 represents the heat of fusion (J/g) originating with the crystalline resin during a first temperature ramp up in measurement on the toner using a differential scanning calorimeter (DSC), and Wt2 represents the heat of fusion (J/g) originating with the crystalline resin during a second temperature ramp up in measurement on the toner using a differential scanning calorimeter (DSC)].

The measurement method here using a differential scanning calorimeter (DSC) is as follows.

0.01 g to 0.02 g of the toner is precisely weighed into an aluminum pan and the DSC curve for the first temperature ramp up is obtained from 0° C. to 200° C. at a ramp rate of 10° C./min.

Cooling is then performed from 200° C. to −100° C. at a cooling rate of 10° C./min, and temperature ramp up is performed again from −100° C. to 200° C. at a ramp rate of 10° C./min to obtain the DSC curve for the second temperature ramp up.

The heat of fusion per unit mass (J/g) is determined from the mass of the measurement sample and the area, in the DSC curve of the first and second temperature ramp up, bounded by the melting endothermic peak and the straight line provided by extending the baseline on the low temperature side to the high temperature side.

When the amorphous resin and crystalline resin are a combination with a high compatibility therebetween, the crystalline resin undergoes melting due to the first temperature ramp up and compatibilization with the amorphous resin is brought about. When, after this, cooling to −100° C. is carried out at a cooling rate of 10° C./min, the crystalline resin does not undergo a thorough crystallization and remains compatibilized. As a result, the heat of fusion (J/g) originating with the crystalline resin is reduced when the second temperature ramp up is performed.

This behavior becomes more significant as the compatibility between the amorphous resin and crystalline resin becomes higher. That is, as the compatibility between the amorphous resin and the crystalline resin increases, the heat of fusion (J/g) originating with the crystalline resin during the second temperature ramp up grows increasingly smaller than the heat of fusion (J/g) originating with the crystalline resin during the first temperature ramp up.

When (Wt2/Wt1) exceeds 0.50, the compatibility between the amorphous resin and crystalline resin is inadequate and as a consequence an adequate plasticization of the amorphous resin is not brought about and the low-temperature fixability deteriorates.

(Wt2/Wt1) is preferably not more than 0.45 and is more preferably not more than 0.40. As this value grows smaller, the development of compatibilization is facilitated and a better low-temperature fixability is thus obtained. The lower limit value for (Wt2/Wt1) is 0.00.

When a release agent is present in the toner, a melting endothermic peak originating with the release agent may be observed. In such a case Wt2 and Wt1 are determined as follows.

The release agent is extracted from the toner by Soxhlet extraction using hexane as the solvent, and the extracted release agent is subjected by itself to DSC measurement by the method described above to determine the heat of fusion per unit mass (J/g) of the release agent. The heat of fusion per unit mass (J/g) of the release agent may then be subtracted from the heat of fusion per unit mass (J/g) of the toner.

On the other hand, with regard to the crystalline resin present in the toner, after the release agent has been extracted from the toner by Soxhlet extraction using hexane as the solvent, the crystalline resin alone may be separated by utilizing the differential solubilities in solvent of the amorphous resin and crystalline resin.

A specific example of the separation of only the crystalline resin is a method in which the crystalline resin alone is isolated as the residue by Soxhlet extraction using ethyl acetate as the solvent. That this extraction residue is the crystalline resin can be confirmed by DSC measurement. NMR measurements may also be run in order to confirm the molecular structure of the crystalline resin that is the extraction residue.

The content (mass %) of the crystalline resin in the toner particle is obtained by dividing the mass (g) of the crystalline resin separated from the toner by the mass (g) of the toner and multiplying by 100.

The constituent materials that constitute the toner of the present invention are described below.

<Crystalline Resin>

The crystalline resin in the present invention is a resin that exhibits crystallinity and a high compatibility with the amorphous resin, but is not otherwise particularly limited, and a suitable selection can be made in conformity with the objectives.

The crystalline resin exhibits a melting endothermic peak in differential scanning calorimetric measurement using a differential scanning calorimeter (DSC).

The crystalline resin can be exemplified by crystalline polyester resins, crystalline polyurethane resins, crystalline polyurea resins, crystalline polyamide resins, crystalline polyether resins, crystalline vinyl resins, and modified crystalline resins. A single one of these may be used by itself or two or more may be used in combination.

Among the preceding, crystalline polyester resins are preferred from the standpoint of the melting point and mechanical strength. There are no particular limitations on the structure of the crystalline polyester resin, but an example here is a structure obtained by the condensation polymerization of at least one dicarboxylic acid component and at least one diol component.

The diol component can be specifically exemplified by the following, although $C_{4-20}$ straight-chain aliphatic diols are preferred from the standpoint of the ester group concentration, vide infra, and the melting point:

diols such as ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, 2-methyl-1,3-propanediol, cyclohexanediol, and cyclohexanedimethanol.

Trihydric and higher hydric alcohols can be exemplified by glycerol, pentaerythritol, hexamethylolmelamine, and hexaethylolmelamine. A single one of these may be used by itself or two or more may be used in combination.

The dicarboxylic acid can be specifically exemplified by the following, although $C_{4-20}$ straight-chain aliphatic dicarboxylic acids are preferred from the standpoint of the ester group concentration, vide infra, and the melting point: oxalic acid, malonic acid, maleic acid, fumaric acid, citraconic acid, itaconic acid, glutaconic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid; alicyclic dicarboxylic acids such as 1,1-cyclopentenedicarboxylic acid, 1,4-cyclohexanedicarboxylic acid, 1,3-cyclohexanedicarboxylic acid, and 1,3-adamantanedicarboxylic acid; and aromatic dicarboxylic acids such as phthalic acid, isophthalic acid, terephthalic acid, p-phenylenediacetic acid, m-phenylenediacetic acid, p-phenylenedipropionic acid, m-phenylenedipropionic acid, naphthalene-1,4-dicarboxylic acid, and naphthalene-1,5-dicarboxylic acid. A single one of these may be used by itself or two or more may be used in combination.

Tribasic and higher basic polybasic carboxylic acids may also be used, and examples here are tribasic and higher basic polybasic carboxylic acids such as trimellitic acid, pyromellitic acid, naphthalenetricarboxylic acid, naphthalenetetracarboxylic acid, pyrenetricarboxylic acid, and pyrenetetracarboxylic acid. A single one of these may be used by itself or two or more may be used in combination.

As indicated above, it is known that crystalline resins generally have a lower volume resistance than conventional amorphous resins. For this reason the present inventors hold as follows.

Crystalline resins generally form a crystalline structure in which the molecular chains exhibit a regular arrangement, and when this is considered macroscopically, a state of restricted molecular motion is thought to be maintained in the temperature region below the melting point. However, when considered microscopically, this does not mean that all of a crystalline resin is constituted of a crystalline structure element, and a crystalline resin is formed from a crystalline structure element, which has a crystalline structure wherein the molecular chains exhibit a regular arrangement, and from an amorphous structure element outside this.

For crystalline polyester resins that have a melting point in the range generally used by toners, the glass transition temperature (Tg) of the crystalline polyester resin is substantially lower than room temperature, and as a consequence, when considered microscopically it is thought that the amorphous structural element undergoes molecular motion even at room temperature. In an environment in which such a resin has a high molecular mobility, it is thought that charge transfer is possible via, for example, the ester bond, which is a polar group, and the volume resistance of the resin is lowered as a result.

Accordingly, based on the hypothesis that the volume resistance can be increased by keeping the polar ester group concentration low, the use is then preferred of a crystalline polyester resin that has a low ester group concentration.

The value of this ester group concentration is determined mainly by the type of diol component and the type of dicarboxylic acid component, and a low value can be established by the selection for each of a component having a large number of carbons.

However, when a low ester group concentration is established, the compatibility with the amorphous resin may decline and/or the obtained crystalline polyester resin may have a high melting point.

The weight-average molecular weight (Mw) of the crystalline resin, as measured using gel permeation chromatography, is preferably from 5,000 to 50,000 and is more preferably from 5,000 to 20,000.

The strength of the resin in the toner and the low-temperature fixability of the toner can be further improved by having the weight-average molecular weight (Mw) of the crystalline resin satisfy the indicated range.

The weight-average molecular weight (Mw) of the crystalline resin can be readily controlled through the various known production conditions for crystalline resins.

The weight-average molecular weight (Mw) of the crystalline resin is measured as follows using gel permeation chromatography (GPC).

Special-grade 2,6-di-tert-butyl-4-methylphenol (BHT) is added at a concentration of 0.10 mass % to o-dichlorobenzene for gel chromatography and is dissolved at room temperature. The crystalline resin and the BHT-containing o-dichlorobenzene are introduced into a sample vial, and the crystalline resin is dissolved by heating on a hot plate set to 150° C.

Once the crystalline resin has dissolved, it is introduced into a preheated filter unit and set into the main unit. The sample that has passed through the filter unit is used as the GPC sample.

The sample solution is adjusted to provide a concentration of approximately 0.15 mass %.

The measurement is carried out under the following conditions using this sample solution.

instrument: HLC-8121 GPC/HT (Tosoh Corporation)
detector: high-temperature RI
column: 2×TSKgel GMHHR-H HT (Tosoh Corporation)
temperature: 135.0° C.
solvent: o-dichlorobenzene for gel chromatography (0.10 mass % BHT added)
flow rate: 1.0 mL/min
injection quantity: 0.4 mL The molecular weight calibration curve used to determine the molecular weight of the crystalline resin is constructed using polystyrene resin standards (product name: "TSK Standard Polystyrene F-850, F-450, F-288, F-128, F-80, F-40, F-20, F-10, F-4, F-2, F-1, A-5000, A-2500, A-1000, and A-500", from the Tosoh Corporation).

The melting point of the crystalline resin in the present invention is preferably from 50° C. to 100° C. from the standpoint of the low-temperature fixability and storability. The low-temperature fixability is further improved by having the melting point be not more than 100° C. The low-temperature fixability is improved still further by having the melting point be not more than 90° C. On the other hand, the storability assumes a declining trend when the melting point is lower than 50° C.

The melting point of the crystalline resin can be measured using a differential scanning calorimeter (DSC).

Specifically, 0.01 g to 0.02 g of the sample is precisely weighed into an aluminum pan and the DSC curve is then obtained by ramping up the temperature from 0° C. to 200° C. at a ramp rate of 10° C./min.

The melting point is taken to be the peak temperature of the melting endothermic peak in the obtained DSC curve.

The melting point of the crystalline resin in the toner can also be measured by the same procedure. Here, a melting point due to a release agent present in the toner may also be observed. The melting point of the release agent is discriminated from the melting point of the crystalline resin by extracting the release agent from the toner by Soxhlet extraction using hexane as the solvent; carrying out differential scanning calorimetric measurement on the release agent alone by the previously described method; and comparing the obtained melting point with the melting point of the toner.

The toner particle in the present invention preferably contains from 10 mass % to 40 mass % of the crystalline resin. A content from 15 mass % to 35 mass % is more preferred.

An even better low-temperature fixability is developed by having the content of the crystalline resin be at least 10 mass %. That is, a high level of low-temperature fixability can be made to coexist with a high level of charging performance by having the content of the crystalline resin in the toner particle be from 10 mass % to 40 mass %.

<Amorphous Resin>

The amorphous resin in the present invention is a resin that exhibits a high compatibility with the crystalline resin, but is not otherwise particularly limited, and a suitable selection can be made from the known amorphous resins commonly used in toners.

The following polymers and resins are specific examples: homopolymers of styrene and its substituted monomers, e.g., polystyrene, poly-p-chlorostyrene, and polyvinyltoluene; styrenic copolymers such as styrene-p-chlorostyrene copolymers, styrene-vinyltoluene copolymers, styrene-vinylnaphthalene copolymers, styrene-acrylate ester copolymers, styrene-methacrylate ester copolymers, styrene-methyl α-chloroacrylate copolymers, styrene-acrylonitrile copolymers, styrene-vinyl methyl ether copolymers, styrene-vinyl ethyl ether copolymers, styrene-vinyl methyl ketone copolymers, and styrene-acrylonitrile-indene copolymers; as well as polyvinyl chloride, phenolic resins, modified phenolic resins, modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, coumarone-indene resins, and petroleum resins. Preferred among the preceding are polyester resins, which have an excellent strength even at low molecular weights and which have a high compatibility with the crystalline polyester that is a preferred structure among the crystalline resins.

Polyester resins provided by the condensation polymerization of an alcohol monomer and a carboxylic acid monomer are used as these polyester resins.

The alcohol monomer can be exemplified by the following: alkylene oxide adducts on bisphenol A, e.g., polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydrophenyl)propane, and polyoxypropylene(6)-2,2-bis(4-hydroxyphenyl)propane, and also ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

The carboxylic acid monomer, on the other hand, can be exemplified by the following:

aromatic dicarboxylic acids such as phthalic acid, isophthalic acid, and terephthalic acid, and their anhydrides; alkyldicarboxylic acids such as succinic acid, adipic acid, sebacic acid, and azelaic acid, and their anhydrides; succinic acid substituted by a $C_{6-18}$ alkyl group or alkenyl group, and anhydrides thereof; and unsaturated dicarboxylic acids such as fumaric acid, maleic acid, and citraconic acid, and anhydrides thereof.

The following monomers may also be used in addition to the preceding:

polyhydric alcohols such as the oxyalkylene ethers of novolac-type phenolic resins; also, polybasic carboxylic acids such as trimellitic acid, pyromellitic acid, and benzophenonetetracarboxylic acid, and anhydrides thereof.

The following are preferred in particular among the preceding: resins provided by the condensation polymerization of a dihydric alcohol monomer component that is a bisphenol derivative represented by the following general formula (1), with a carboxylic acid monomer component that is a carboxylic acid component composed of a dibasic or higher basic carboxylic acid or anhydride or lower alkyl ester thereof (for example, fumaric acid, maleic acid, maleic anhydride, phthalic acid, terephthalic acid, trimellitic acid, and pyromellitic acid)

[C1]

(1)

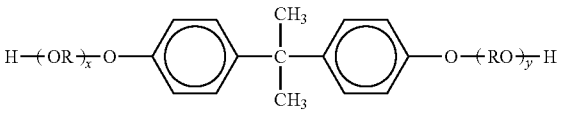

(where, R represents an ethylene group or propylene group; x and y are each an integer equal to or greater than 1; and the average value of x+y is at least 2 and not more than 10).

The glass transition temperature of the amorphous resin is preferably from 30° C. to 80° C.

The storability is improved when the glass transition temperature is at least 30° C. The charging performance is also improved due to a suppression of the decline in resistance caused by the molecular motion of the resin in high-temperature, high-humidity environments.

The low-temperature fixability is improved when, on the other hand, the glass transition temperature is not more than 80° C.

The glass transition temperature is more preferably at least 40° C. from the standpoint of the storability. On the other hand, the glass transition temperature is more preferably not more than 70° C. from the standpoint of the low-temperature fixability.

The glass transition temperature (Tg) can be measured using a differential scanning calorimeter (DSC822/EK90 from Mettler-Toledo International Inc.).

Specifically, 0.01 g to 0.02 g of the sample is precisely weighed into an aluminum pan and the temperature is raised from 0° C. to 200° C. at a ramp rate of 10° C./min. This is followed by cooling from 200° C. to −100° C. at a cooling rate of 10° C./min and reheating from −100° C. to 200° C. at a ramp rate of 10° C./min to obtain the DSC curve.

The glass transition temperature is taken to be the temperature on the resulting DSC curve of the intersection between the straight line provided by extending the baseline on the low temperature side to the high temperature side, and the tangent line drawn at the point where the slope of the curve in the stepwise change region of the glass transition assumes a maximum.

The softening temperature (Tm) of the amorphous resin in the present invention is preferably from 70° C. to 150° C., more preferably from 80° C. to 140° C., and even more preferably from 80° C. to 130° C.

When the softening temperature (Tm) is in the indicated range, a good coexistence is established between the blocking resistance and offset resistance; in addition, a suitable penetration occurs into the paper by the melted toner component during fixing at elevated temperature and an excellent surface smoothness is obtained.

The softening temperature (Tm) of the amorphous resin can be measured in the present invention using a "Flowtester CFT-500D Flow Property Evaluation Instrument" (Shimadzu Corporation), which is a constant-load extrusion-type capillary rheometer.

The CFT-500D is an instrument that applies a constant load from above using a piston, during which the measurement sample filled in a cylinder is heated and melted and extruded from a capillary orifice at the bottom of the cylinder, and that can graph out a flow curve from the piston stroke (mm) and the temperature (° C.).

The softening temperature (Tm) in the present invention is the "melting temperature by the ½ method" described in the manual provided with the "Flowtester CFT-500D Flow Property Evaluation Instrument".

The melting temperature by the ½ method is determined as follows.

First, ½ of the difference between the piston stroke at the completion of outflow (outflow completion point, Smax) and the piston stroke at the start of outflow (minimum point, Smin) is determined (this is designated as X, where X=(Smax−Smin)/2). The temperature of the flow curve when the piston stroke becomes the sum of X and Smin is the melting temperature by the ½ method.

The measurement sample used is prepared by subjecting 1.2 g of the amorphous resin to compression molding for 60 seconds at 10 MPa in a 25° C. environment using a tablet compression molder (for example the NT-100H Standard Manual Newton Press from NPa System Co., Ltd.) to provide a cylindrical shape with a diameter of 8 mm.

The specific measurement procedure is in accordance with the manual provided with the instrument.

The measurement conditions with the CFT-500D are as follows.

test mode: rising temperature method
start temperature: 60° C.
saturated temperature: 200° C.
measurement interval: 1.0° C.

ramp rate: 4.0° C./min
piston cross section area: 1.000 $cm^2$
test load (piston load): 5.0 kgf
preheating time: 300 seconds
diameter of die orifice: 1.0 mm
die length: 1.0 mm The amorphous resin preferably has an ionic group, i.e., the carboxylic acid group, sulfonic acid group, or amino group, in the resin skeleton, and more preferably has the carboxylic acid group.

The acid value of the amorphous resin is preferably from 3 mg KOH/g to 35 mg KOH/g and is more preferably from 8 mg KOH/g to 25 mg KOH/g.

When the acid value of the amorphous resin is in the indicated range, an excellent charge quantity is obtained in both a high-humidity environment and a low-humidity environment. The acid value is the mass (mg) of potassium hydroxide required to neutralize, for example, the free fatty acid, resin acid, and so forth, present in 1 g of the sample. With regard to the measurement method, measurement is carried out in accordance with JIS K 0070.

The crystalline resin and amorphous resin in the present invention are a high-compatibility combination.

The following may be considered in order to select a high-compatibility combination for the crystalline resin and amorphous resin.

(1) A crystalline resin and an amorphous resin are selected that have the same main backbone for the resin. For example, a crystalline polyester resin may be used for the crystalline resin and an amorphous polyester resin may be used for the amorphous resin. In addition, a crystalline acrylic resin may be used for the crystalline resin and an amorphous acrylic resin may be used for the amorphous resin.

(2) Moreover, the absolute value (ASP value) of the difference between the solubility parameter values (SP values) of the crystalline resin and amorphous resin used is preferably from 0.00 to 1.67, more preferably from 0.00 to 1.65, and even more preferably from 0.00 to 1.60.

This SP value can be determined using Fedor's equation. Here, for the values of Δei and Δvi reference was made to "Energies of Vaporization and Molar Volumes (25° C.) of Atoms and Atomic Groups" in Table 3-9 of "Basic Coating Science" (pp. 54-57, 1986 (Maki Shoten Publishing)).

$$\delta i=[Ev/V]^{(1/2)}=[\Delta ei/\Delta vi]^{(1/2)} \quad \text{equation:}$$

Ev: energy of vaporization
V: molar volume
Δei: energy of vaporization of the atoms or atomic groups of component i
Δvi: molar volume of the atoms or atomic groups of component i For example, a crystalline polyester formed from nonanediol and sebacic acid is constructed of (—COO)×2+(—$CH_2$)×17 atomic groups as the repeat unit, and its calculated SP value is determined from the following formula.

$$\delta i=[\Delta ei/\Delta vi]^{(1/2)}=[\{(4300)\times 2+(1180)\times 17\}/\{(18)\times 2+(16.1)\times 17\}]^{(1/2)}$$

The SP value (δi) then evaluates to 9.63.

The ratio on a mass basis of the crystalline resin with respect to the amorphous resin in the present invention is preferably 5:95 to 50:50, more preferably 10:90 to 40:60, and even more preferably 15:85 to 30:70.

<Colorant>

The toner of the present invention may contain a colorant, which can be exemplified by the known organic pigments, dyes, carbon blacks, and magnetic powders.

The cyan colorants can be exemplified by copper phthalocyanine compounds and their derivatives, anthraquinone compounds, and basic dye lake compounds. Specific examples are C. I. Pigment Blue 1, C. I. Pigment Blue 7, C. I. Pigment Blue 15, C. I. Pigment Blue 15:1, C. I. Pigment Blue 15:2, C. I. Pigment Blue 15:3, C. I. Pigment Blue 15:4, C. I. Pigment Blue 60, C. I. Pigment Blue 62, and C. I. Pigment Blue 66.

The magenta colorants can be exemplified by condensed azo compounds, diketopyrrolopyrrole compounds, anthraquinone, quinacridone compounds, basic dye lake compounds, naphthol compounds, benzimidazolone compounds, thioindigo compounds, and perylene compounds. Specific examples are C. I. Pigment Red 2, C. I. Pigment Red 3, C. I. Pigment Red 5, C. I. Pigment Red 6, C. I. Pigment Red 7, C. I. Pigment Violet 19, C. I. Pigment Red 23, C. I. Pigment Red 48:2, C. I. Pigment Red 48:3, C. I. Pigment Red 48:4, C. I. Pigment Red 57:1, C. I. Pigment Red 81:1, C. I. Pigment Red 122, C. I. Pigment Red 144, C. I. Pigment Red 146, C. I. Pigment Red 166, C. I. Pigment Red 169, C. I. Pigment Red 177, C. I. Pigment Red 184, C. I. Pigment Red 185, C. I. Pigment Red 202, C. I. Pigment Red 206, C. I. Pigment Red 220, C. I. Pigment Red 221, and C. I. Pigment Red 254.

The yellow colorants can be exemplified by condensed azo compounds, isoindolinone compounds, anthraquinone compounds, azo metal complexes, methine compounds, and allylamide compounds. Specific examples are C. I. Pigment Yellow 12, C. I. Pigment Yellow 13, C. I. Pigment Yellow 14, C. I. Pigment Yellow 15, C. I. Pigment Yellow 17, C. I. Pigment Yellow 62, C. I. Pigment Yellow 74, C. I. Pigment Yellow 83, C. I. Pigment Yellow 93, C. I. Pigment Yellow 94, C. I. Pigment Yellow 95, C. I. Pigment Yellow 97, C. I. Pigment Yellow 109, C. I. Pigment Yellow 110, C. I. Pigment Yellow 111, C. I. Pigment Yellow 120, C. I. Pigment Yellow 127, C. I. Pigment Yellow 128, C. I. Pigment Yellow 129, C. I. Pigment Yellow 147, C. I. Pigment Yellow 151, C. I. Pigment Yellow 154, C. I. Pigment Yellow 155, C. I. Pigment Yellow 168, C. I. Pigment Yellow 174, C. I. Pigment Yellow 175, C. I. Pigment Yellow 176, C. I. Pigment Yellow 180, C. I. Pigment Yellow 181, C. I. Pigment Yellow 191, and C. I. Pigment Yellow 194.

The black colorants can be exemplified by carbon blacks, magnetic powders, and colorants adjusted to black using a yellow colorant, magenta colorant, and cyan colorant.

These colorants can be used individually or in mixture and can be used in the form of a solid solution. The colorant should be selected considering the hue angle, chroma, lightness, lightfastness, and OHP transparency and the dispersity in the toner. The colorant content is preferably from 1 mass parts to 20 mass parts per 100 mass parts of the resin component constituting the toner.

<Release Agent>

The toner of the present invention may contain a release agent, which is exemplified by the following:

low molecular weight polyolefins such as polyethylenes; silicones that exhibit a melting point (softening point) upon the application of heat; fatty acid amides such as oleamide, erucamide, ricinoleamide, and stearamide; ester waxes such as stearyl stearate; vegetable waxes such as carnauba wax, rice wax, candelilla wax, Japanese wax, and jojoba oil; animal waxes such as beeswax; mineral and petroleum waxes such as montan wax, ozokerite, ceresin, paraffin waxes, microcrystalline wax, Fischer-Tropsch waxes, and ester waxes; and modifications of the preceding.

The content of the release agent is preferably from 1 mass parts to 25 mass parts per 100 mass parts of the resin component constituting the toner.

It has been quite difficult to bring about the formation of microscopic and spherical domains of the crystalline resin in a matrix of the amorphous resin in conventional toner production methods when the crystalline resin and amorphous resin are a combination with high compatibility therebetween.

With the present invention, a method was discovered in which microscopic and spherical microparticles of the crystalline resin are produced in an aqueous medium and this is subsequently introduced, as such and without melting or dissolving this crystalline resin, into a highly compatible amorphous resin.

Thus, the toner of the present invention is a toner produced using a production method that has an aggregation step of obtaining aggregate particles by mixing an amorphous resin microparticle dispersion in which microparticles of the amorphous resin are dispersed, with a crystalline resin microparticle dispersion in which microparticles of the crystalline resin are dispersed and optionally with a release agent microparticle dispersion in which microparticles of a release agent are dispersed and a colorant microparticle dispersion in which microparticles of a colorant are dispersed, and carrying out an aggregation in which the microparticles, including the amorphous resin microparticles and the crystalline resin microparticles and optionally the release agent microparticles and colorant microparticles, are aggregated; and a fusion step of carrying out a fusion treatment on the aggregate particles by adding, at a fusion treatment temperature set to a temperature that is not larger than the onset temperature of the crystal melting peak of the crystalline resin as measured with a differential scanning calorimeter (DSC), an organic solvent that at the fusion treatment temperature is a good solvent for the amorphous resin and a poor solvent for the crystalline resin.

The emulsion aggregation method used as the toner production method in the present invention is a method in which particles are obtained by preliminarily preparing dispersions of microparticles that are formed from the toner constituent materials and are sufficiently smaller than the target particle diameter; aggregating these microparticles until the toner particle diameter is reached; and carrying out fusion on the obtained aggregate particles.

The toner of the present invention is produced by carrying out a fusion treatment, after the aforementioned aggregate particles have been formed, on the aggregate particles at a fusion treatment temperature set to a temperature that is not larger than the onset temperature of the crystal melting peak of the crystalline resin as measured with a differential scanning calorimeter (DSC), by adding an organic solvent that at the fusion treatment temperature is a good solvent for the amorphous resin and a poor solvent for the crystalline resin.

When this production method is used, the aggregate particles can undergo a fusion in which domains formed from the microparticles of the crystalline resin remain present as such and in which the amorphous resin undergoes modification through plasticization of only the amorphous resin. As a result, a toner can be obtained in which microscopic and spherical domains of the crystalline resin are formed in a matrix of the amorphous resin.

The aggregation step and fusion step will be further described.

<Aggregation Step>

In the aggregation step, a mixture is prepared by mixing an amorphous resin microparticle dispersion in which microparticles of the amorphous resin are dispersed, with a crystalline resin microparticle dispersion in which microparticles of the crystalline resin are dispersed and optionally with a release agent microparticle dispersion in which microparticles of a release agent are dispersed and a colorant microparticle dispersion in which microparticles of a colorant are dispersed. The various microparticles present in the prepared mixture are then aggregated to form aggregate particles having the particle diameter of the target toner particle. Here, the formation of aggregate particles—in which the resin microparticles, colorant microparticles, and release agent microparticles are aggregated—is brought about by the addition of an aggregating agent with mixing and as necessary by the suitable application of heating and/or mechanical force. The dispersion step of producing the microparticle dispersions of the toner constituent materials is described below.

An aggregating agent containing an at least divalent metal ion is preferably used as the aggregating agent here. Aggregating agents that contain an at least divalent metal ion have a high aggregative power and through their addition in small amounts can ionically neutralize the acidic polar groups in the resin microparticles as well as the ionic surfactant present in the aqueous dispersions of resin microparticles, the aqueous dispersion of colorant microparticles, and the aqueous dispersion of release agent microparticles. The resin microparticles, colorant microparticles, and release agent microparticles are as a result aggregated through the effects of salting out and ion crosslinking.

The aggregating agent containing an at least divalent metal ion can be exemplified by at least divalent metal salts and by metal salt polymers. Specific examples are inorganic divalent metal salts such as calcium chloride, calcium nitrate, magnesium chloride, magnesium sulfate, and zinc chloride; trivalent metal salts such as iron(III) chloride, iron(III) sulfate, aluminum sulfate, and aluminum chloride; and inorganic metal salt polymers such as polyaluminum chloride, polyaluminum hydroxide, and calcium polysulfide; however, there is no limitation to the preceding. A single one of these may be used by itself or two or more may be used in combination.

The aggregating agent may be added in the form of the dry powder or in the form of the aqueous solution prepared by dissolution in an aqueous medium; however, addition in the form of the aqueous solution is preferred in order to bring about a uniform aggregation.

In addition, the addition and mixing of the aggregating agent is preferably carried out at a temperature at or below the glass transition temperature of the resin present in the mixture. A uniform aggregation is developed by executing mixing under this temperature condition. The aggregating agent can be mixed into the mixture using a known mixing apparatus, such as a homogenizer or a mixer.

There are no particular limitations on the average particle diameter of the aggregate particles formed in this aggregation step, but the volume-average particle diameter is preferably controlled to from 3 μm to 10 μm. The particle diameter of the aggregate particles can be readily controlled through judicious adjustment of the temperature, solids concentration, concentration of the aggregating agent, and stirring conditions.

A toner particle having a core/shell structure can be produced by proceeding through a shell attachment step, in which resin microparticles are attached to the surface of the aggregate particles by the addition to the dispersion of aggregate particles obtained in the aggregation step of resin microparticles in order to additionally form a shell phase, and through a fusion step, discussed below, in which the aggregate particles having the resin microparticles attached to the surface are fused. The resin microparticles for forming the shell phase that are added here may be resin microparticles having the same structure as the resin in the aggregate particles or may be resin microparticles that have a different structure.

<Fusion Step>

In the fusion step, an aggregation inhibitor is added, under the same stirring as in the aggregation step, to the aggregate particle-containing dispersion provided by the aggregation step. This aggregation inhibitor can be exemplified by basic compounds that shift the equilibrium for the acidic polar groups in the resin microparticles to the dissociation side and stabilize the aggregate particles, and by chelating agents that stabilize the aggregate particles through the partial dissociation of the ion crosslinks between the acidic polar groups in the resin microparticles and the metal ion aggregating agent, with the formation of coordination bonds with the metal ion. Chelating agents, which have the greater aggregation-inhibiting effect, are preferred therebetween.

After the state of dispersion of the aggregate particles in the dispersion has been stabilized by the action of the aggregation inhibitor, the aggregate particles are subjected to a fusion treatment by adjusting the temperature of the dispersion to a fusion treatment temperature set to a temperature not greater than the onset temperature of the crystal melting peak of the crystalline resin as measured with a differential scanning calorimeter (DSC), and adding to the dispersion an organic solvent that at the fusion treatment temperature is a good solvent for the amorphous resin and a poor solvent for the crystalline resin.

By using this method, the aggregate particles undergo fusion with domains formed from the microparticles of the crystalline resin remaining present as such while only the amorphous resin is plasticized and modified.

That is, by utilizing the difference in the solubilities of the amorphous resin and crystalline resin in a specific organic solvent, a phase-separated structure is obtained in which only the crystalline resin maintains the microparticle form that is present in the aggregate particles, and as such is dispersed in a matrix of the amorphous resin.

This method, because it lacks a step—as in conventional toner production methods—in which the crystalline resin is dissolved or melted, can form such a phase-separated structure at the same time that the crystalline resin and amorphous resin are a high-compatibility combination.

Moreover, with this method, due to the use of an emulsion aggregation technique, the microparticles provided by the dispersion step, see below, remain as such to become crystalline resin domains. The particle diameter and shape of the crystalline resin domains can thus be controlled to microscopic and spherical. As a result, the toner of the present invention can exhibit high levels for the low-temperature fixability, storability, and charging performance all at the same time.

The chelating agent may be a known water-soluble chelating agent but is not otherwise particularly limited. Specific examples are oxycarboxylic acids such as tartaric acid, citric acid, and glyconic acid, and their sodium salts, as well as iminodiacetic acid (IDA), nitrilotriacetic acid (NTA), and ethylenediaminetetraacetic acid (EDTA), and their sodium salts.

By coordinating to the metal ion of the aggregating agent present in the dispersion of the aggregate particles, the chelating agent can convert the environment in this dispersion from an electrostatically unstable, readily aggregative state to an electrostatically stable state in which additional aggregation is suppressed. As a consequence of this, additional aggregation of the aggregate particles in the dispersion can be suppressed and the aggregate particles can be stabilized.

This chelating agent is preferably an organic metal salt that has at least tribasic carboxylic acid because such a chelating agent is effective even at small amounts of addition and also provides toner particles having a sharp particle size distribution.

Viewed from the perspective of having the cleaning efficiency coexist with stabilization from the aggregated state, the quantity of addition for the chelating agent, expressed per 100 mass parts of the resin particles, is preferably from 1 mass parts to 30 mass parts and is more preferably from 2.5 mass parts to 15 mass parts.

<Organic Solvent>

The organic solvent used in the fusion step in the present invention should be a good solvent for the amorphous resin and a poor solvent for the crystalline resin, but is not otherwise particularly limited.

When this organic solvent is a good solvent for both the amorphous resin and the crystalline resin, the amorphous resin and crystalline resin end up undergoing mutual dissolution in the fusion step and it is then difficult to obtain the toner of the present invention. When, on the other hand, it is a poor solvent for both the amorphous resin and the crystalline resin, the solvent does not penetrate into the amorphous resin and plasticization does not occur, and as a consequence fusion of the aggregate particles is impaired unless a thorough heat treatment exceeding the melting point of the crystalline resin is performed; it is then difficult to obtain the toner of the present invention as a result.

In the present invention, a poor solvent is a solvent for which the solubility of the resin at the fusion treatment temperature in the fusion step is less than 10 g/L. On the other hand, in the present invention, a good solvent is a solvent for which the solubility of the resin at the fusion treatment temperature in the fusion step is at least 100 g/L.

That is, in the present invention, a good solvent for the amorphous resin is a solvent for which the solubility of the amorphous resin at the fusion treatment temperature in the fusion step is at least 100 g/L, while a poor solvent for the crystalline resin is a solvent for which the solubility of the crystalline resin at the fusion treatment temperature in the fusion step is less than 10 g/L.

Larger differences between the solubility of the amorphous resin in the organic solvent and the solubility of the crystalline resin in the organic solvent are more desirable. Viewed from the standpoint of maintaining the crystalline resin domains in the aggregate particles as described above, it is more important that the crystalline resin not undergo dissolution, and for this reason the solubility of the crystalline resin at the fusion treatment temperature in the fusion step is preferably not more than 5 g/L.

The solubility of the amorphous resin and crystalline resin in the organic solvent is determined by the following method in the present invention.

A prescribed mass (1 g to 200 g) of the amorphous resin or crystalline resin is added to 1 L of the organic solvent; stirring is carried out for 12 hours at the fusion treatment temperature (for example, 25° C.) used in the fusion step; and after this the solubility is evaluated based on the turbidity and presence/absence of precipitated material.

When the organic solvent has a low solubility in water, it may undergo phase separation as an oil phase in an aqueous dispersion that contains the aggregate particles. The aggregate particles may then be incorporated into this oil phase with the production of a coarse powder, and the organic solvent is therefore preferably a hydrophilic solvent. In the present invention, this hydrophilic solvent preferably has a solubility in water at the fusion treatment temperature in the fusion step of at least 50 g/L.

The organic solvent can be specifically exemplified by ethyl acetate, methyl acetate, methyl ethyl ketone, and isopropanol, but there is no limitation to this.

The amount of addition of the organic solvent in the fusion step cannot be unconditionally specified because the dissolution behavior varies with the type of crystalline resin, the type of amorphous resin, and the type of organic solvent used.

Larger amounts of addition with reference to the resin promote plasticization of the amorphous resin and support a more rapid development of the fusion step. However, when the amount of addition is too large, a condition may be set up in which the crystalline resin readily dissolves in the organic solvent and the phase-separated structure collapses, or the organic solvent may undergo phase separation as an oil phase and a coarse powder may then be produced.

Accordingly, the amount of addition for the organic solvent, expressed per 100 mass parts of the resin component, is preferably from 1 mass parts to 500 mass parts and is more preferably from 50 mass parts to 350 mass parts. When an organic solvent is used that has a low solubility in water, for example, deionized water may be added to the aggregate particle-containing aqueous dispersion in order to increase the amount of addition of the organic solvent with respect to the resin component.

Viewed from the standpoint of avoiding the production of coarse particles, the organic solvent is preferably added in the fusion step while thorough stirring is being carried out. Moreover, when the organic solvent is added, the addition to the aggregate particle-containing aqueous dispersion is preferably carried out with the organic solvent dissolved or suspended in an aqueous medium containing, for example, a surfactant.

The temperature when the treatment with the organic solvent is carried out in the fusion step (i.e., the fusion treatment temperature), is set to equal to or less than the onset temperature of the crystal melting peak of the crystalline resin as measured with a differential scanning calorimeter (DSC).

The fusion treatment of the aggregate particles is performed with the addition of the organic solvent that is a good solvent for the amorphous resin at the fusion treatment temperature and a poor solvent for the crystalline resin at the fusion treatment temperature.

At higher temperatures for the fusion treatment temperature in the range indicated above, a prescribed average circularity can be achieved in a shorter period of time in association with the decline in the viscosity of the amorphous resin.

Accordingly, the fusion treatment temperature is preferably equal to or less than the onset temperature of the aforementioned crystal melting peak and greater than or equal to 5° C. and is more preferably greater than or equal to 20° C. and equal to or less than the temperature that is 20° C. lower than the onset temperature of the crystal melting peak.

The time required for the fusion treatment cannot be unconditionally specified because it depends on the temperature and amount of organic solvent addition during the treatment with the organic solvent; however, from 30 minutes to 10 hours is generally preferred.

Once the aggregate particles have undergone fusion and the obtained toner particles have reached the target average circularity, the modification/fusion of the toner particles is stopped by cooling and the application of reduced pressure to remove the organic solvent.

The target average circularity here is preferably from 0.920 to 0.990 and is more preferably from 0.940 to 0.980. An average circularity of at least 0.920 means that a thoroughly fused toner particle has been obtained.

The average circularity of the obtained toner particles is measured and determined using an "FPIA-3000" (Sysmex Corporation), a flow-type particle image analyzer, in accordance with the operating manual provided with the instrument. On the other hand, the onset temperature for the crystal melting peak of the crystalline resin is measured with a differential scanning calorimeter (DSC) using the following instrument and method.

measurement instrument: differential scanning calorimeter (DSC822/EK90 from Mettler-Toledo International Inc.)

measurement method:

0.01 g to 0.02 g of the crystalline resin is precisely weighed into an aluminum pan and the DSC curve for the first temperature ramp up is obtained by raising the temperature from 0° C. to 200° C. at a ramp rate of 10° C./min. The "onset temperature for the crystal melting peak" is taken to be the temperature on the resulting DSC curve of the intersection between the straight line provided by extending the baseline on the lower temperature side than the crystal melting peak of the crystalline resin to the higher temperature side, and the tangent line drawn at the point where the slope for the curve on the low temperature side of the crystal melting peak assumes a maximum.

Each of the steps other than the aggregation step and fusion step are described in detail in the following.

Known methods can be used to prepare the resin microparticle dispersions in which microparticles of the amorphous resin or crystalline resin are dispersed.

The known methods can be exemplified by emulsion polymerization methods; self-emulsification methods; phase-inversion emulsification methods, wherein the resin is emulsified by adding an aqueous medium to a solution of the resin dissolved in an organic solvent; and forced emulsification methods, in which the resin is forcibly emulsified, without using an organic solvent, by treatment at high temperatures in an aqueous medium. More specifically, the amorphous resin or crystalline resin is dissolved in an organic solvent that will dissolve the amorphous resin or crystalline resin, and a surfactant and/or basic compound is added. Then, while stirring with, for example, a homogenizer, an aqueous medium is slowly added and resin microparticles are precipitated. This is followed by the removal of the solvent by the application of heating or reduced pressure to produce a resin microparticle dispersion. The organic solvent used for dissolution may be any organic solvent capable of dissolving the resin; however, the use of an organic solvent that forms a uniform phase with water, e.g., tetrahydrofuran, is preferred from the standpoint of suppressing the production of coarse powder.

There are no particular limitations on the surfactant, and it can be exemplified by anionic surfactants such as sulfate ester salt systems, sulfonate salt systems, carboxylate salt systems, phosphate ester systems, and soaps; cationic surfactants such as amine salt types and quaternary ammonium salt types; and nonionic surfactants such as polyethylene glycol systems, alkylphenol/ethylene oxide adduct systems, and polyhydric alcohol systems. A single one of these surfactants may be used by itself or two or more may be used in combination.

The basic compound can be exemplified by inorganic bases such as sodium hydroxide and potassium hydroxide and by organic bases such as ammonia, triethylamine, trimethylamine, dimethylaminoethanol, and diethylaminoethanol. A single one of these basic compounds may be used by itself or two or more may be used in combination.

The 50% particle diameter on a volume basis (d50) of the amorphous resin microparticles in the present invention is preferably from 0.05 μm to 1.00 μm and is more preferably from 0.05 μm to 0.40 μm.

Adjusting the 50% particle diameter on a volume basis (d50) into the indicated range facilitates obtaining a toner particle that has a suitable volume-average particle diameter (3 μm to 10 μm) as the toner particle. The 90% particle diameter on a volume basis (d90) of the crystalline resin microparticles in the present invention is preferably from 0.05 μm to 0.50 μm and is more preferably from 0.05 μm to 0.30 μm.

Even after the fusion step, the crystalline resin microparticles retain their form unchanged and thereby form domains in the toner particle. Thus, when the 90% particle diameter on a volume basis (d90) exceeds 0.50 m, the crystalline resin then readily becomes exposed at the toner surface.

The 50% particle diameter on a volume basis (d50) and the 90% particle diameter on a volume basis (d90) are measured using a dynamic light scattering particle size distribution analyzer (Nanotrac UPA-EX150, from Nikkiso Co., Ltd.) in accordance with the operating manual supplied with the instrument.

A known method can be used to prepare the colorant microparticle dispersion in which microparticles of the aforementioned colorant are dispersed. For example, production may be carried out by mixing the colorant, an aqueous medium, and a dispersing agent using a known mixer such as a stirring device, emulsifying device, or dispersing device.

A known surfactant or high molecular weight dispersing agent can be used as the dispersing agent here.

Either of these dispersing agents, i.e., the surfactant and high molecular weight dispersing agent, can be removed in a step of washing the toner, but surfactants are preferred from the standpoint of the washing efficiency. Among surfactants, anionic surfactants and nonionic surfactants are more preferred.

The amount of the dispersing agent, expressed per 100 mass parts of the colorant, is preferably from 1 mass parts to 20 mass parts and, viewed in terms of having the dispersion stability coexist in good balance with the toner washing efficiency, is more preferably from 2 mass parts to 10 mass parts.

The content of the colorant in the colorant microparticle dispersion is not particularly limited, but is preferably from 1 mass % to 30 mass % with reference to the total mass of the colorant microparticle dispersion.

With regard to the dispersed particle diameter of the colorant microparticles in the aqueous medium, the 50% particle diameter on a volume basis (d50) is preferably not more than 0.50 μm viewed in terms of the dispersibility of the colorant in the toner. For the same reason, the 90% particle diameter on a volume basis (d90) is preferably not more than 2 μm.

The dispersed particle diameter of the colorant microparticles is measured using a dynamic light scattering particle size distribution analyzer (Nanotrac UPA-EX150, from Nikkiso Co., Ltd.) in accordance with the operating manual supplied with the instrument.

The aforementioned known mixer such as a stirring device, emulsifying device, or dispersing device can be exemplified by ultrasound homogenizers, jet mills, pressure homogenizers, colloid mills, ball mills, sand mills, and paint shakers. A single one of these or a combination of them may be used.

The surfactant can be exemplified by anionic surfactants such as sulfate ester salt systems, sulfonate salt systems, phosphate ester systems, and soaps; cationic surfactants such as amine salt types and quaternary ammonium salt types; and nonionic surfactants such as polyethylene glycol systems, alkylphenol/ethylene oxide adduct systems, and polyhydric alcohol systems. Nonionic surfactants and anionic surfactants are preferred among the preceding. A nonionic surfactant may be used in combination with an anionic surfactant. A single one of these surfactants may be used by itself or two or more may be used in combination. The concentration of the surfactant in the aqueous medium is preferably from 0.5 mass % to 5 mass %.

The content of the colorant, expressed per 100 mass parts of the resin component constituting the toner, is preferably from 1 mass parts to 20 mass parts.

A known method can be used to produce the release agent microparticle dispersion in which microparticles of the aforementioned release agent are dispersed. For example, an aqueous dispersion of release agent microparticles can be prepared by adding the release agent to an aqueous medium that contains a surfactant; heating to at least the melting point of the release agent and in combination therewith dispersing into particulate form with a homogenizer that has a strong shearing capacity (for example, a "Clearmix W-Motion" from M Technique Co., Ltd.) or a pressure-ejection dispersing device (for example, a "Gaulin Homogenizer" from Gaulin Co., Ltd.); and subsequently cooling to at or below the melting point.

With regard to the dispersed particle diameter of the release agent microparticles in the aqueous medium, the 50% particle diameter on a volume basis (d50) is preferably from 0.03 μm to 1.00 μm and is more preferably from 0.10 μm to 0.50 μm. Coarse particles larger than 1.00 μm are preferably not present.

By having the dispersed particle diameter of the release agent microparticles be in the indicated range, an excellent elution by the release agent is obtained during fixing and the hot offset temperature can then be raised; in addition, the generation of filming on the photosensitive member can be inhibited.

The dispersed particle diameter of the release agent microparticles is measured using a dynamic light scattering particle size distribution analyzer (Nanotrac UPA-EX150, from Nikkiso Co., Ltd.) in accordance with the operating manual supplied with the instrument.

The content of the release agent, per 100 mass parts of the resin component constituting the toner, is preferably from 1 mass parts to 25 mass parts.

A toner can be obtained by subjecting the particles produced through the above-described steps to washing, filtration, drying, and so forth. This is followed by drying and as necessary by the addition, under the application of shear force and in a dry state, of inorganic microparticles of, e.g., silica, alumina, titania, calcium carbonate, and so forth, and/or resin microparticles of, e.g., a vinyl resin, polyester resin, silicone resin, and so forth. The inorganic microparticles and resin microparticles function as external additives, such as a flowability auxiliary agent or a cleaning auxiliary agent.

EXAMPLES

The present invention is described in additional detail herebelow using examples and comparative examples, but the aspects and embodiments of the present invention are not limited to or by these. Unless specifically indicated otherwise, the number of parts and % in the examples and comparative examples are on a mass basis in all instances.

<Production of Amorphous Resin Microparticle 1>

| | |
|---|---|
| tetrahydrofuran (Wako Pure Chemical Industries, Ltd.) | 200 g |
| polyester resin A [composition (molar ratio) [polyoxypropylene(2.2)-2,2-bis(4-hydroxyphenyl)propane:isophthalic acid:terephthalic acid = 100:50:50], number-average molecular weight (Mn) = 4,600, weight-average molecular weight (Mw) = 16,500, peak molecular weight (Mp) = 10,400, Mw/Mn = 3.6, softening temperature (Tm) = 122° C., glass transition temperature (Tg) = 70° C., acid value = 13 mg KOH/g] | 120 g |
| anionic surfactant (Neogen RK from Dai-ichi Kogyo Seiyaku Co., Ltd.) | 0.6 g |

After the preceding had been mixed, dissolution was carried out by stirring for 12 hours.

2.7 g of N,N-dimethylaminoethanol was then added and stirring was performed at 4,000 rpm using a T. K. Robomix ultrahigh-speed stirrer (PRIMIX Corporation).

360 g of deionized water was additionally added at a rate of 1 g/min to bring about the precipitation of resin microparticles. This was followed by removal of the tetrahydrofuran using an evaporator to obtain amorphous resin microparticle 1 and its dispersion.

The 50% particle diameter on a volume basis (d50) of amorphous resin microparticle 1 was measured using a dynamic light scattering particle size distribution analyzer (Nanotrac, from Nikkiso Co., Ltd.) at 0.13 μm.

<Production of Amorphous Resin Microparticle 2>

A amorphous resin microparticle 2 and its dispersion were obtained proceeding as in Production of Amorphous resin microparticle 1, but changing the polyester resin A to a polyester resin B [composition (molar ratio) [polyoxypropylene(2.2)-2,2-bis(4-hydroxyphenyl)propane:polyoxyethylene(2.0)-2,2-bis(4-hydroxyphenyl)propane:terephthalic acid=35:15:50], Mn=4,500, Mw=12,300, Mw/Mn=2.9, Tm=115° C., Tg=65° C., acid value=12 mg KOH/g]. The 50% particle diameter on a volume basis (d50) of the obtained amorphous resin microparticle 2 was 0.12 μm.

<Production of Amorphous Resin Microparticle 3>

A amorphous resin microparticle 3 and its dispersion were obtained proceeding as in Production of Amorphous resin microparticle 1, but changing the polyester resin A to a polyester resin C [composition (molar ratio) [polyoxypropylene(2.2)-2,2-bis(4-hydroxyphenyl)propane:polyoxyethylene(2.0)-2,2-bis(4-hydroxyphenyl)propane:terephthalic acid=25:25:50], Mn=3,500, Mw=10,300, Mw/Mn=2.9, Tm=110° C., Tg=60° C., acid value=12 mg KOH/g]. The 50% particle diameter on a volume basis (d50) of the obtained amorphous resin microparticle 3 was 0.12 μm.

<Production of Amorphous Resin Microparticle 4>

A amorphous resin microparticle 4 and its dispersion were obtained proceeding as in Production of Amorphous resin microparticle 1, but changing the polyester resin A to a polyester resin D [composition (molar ratio) [polyoxyethylene(2.0)-2,2-bis(4-hydroxyphenyl)propane:terephthalic acid=50:50], Mn=3,900, Mw=12,300, Mw/Mn=3.1, Tm=109° C., Tg=58° C., acid value=12 mg KOH/g]. The 50% particle diameter on a volume basis (d50) of the obtained amorphous resin microparticle 4 was 0.12 μm.

<Production of Amorphous Resin Microparticle 5>

| | |
|---|---|
| tetrahydrofuran (Wako Pure Chemical Industries, Ltd.) | 200 g |
| styrene-acrylic resin A [composition (molar ratio) [styrene:butyl acrylate:stearyl acrylate:acrylic acid = 75:10:10:5], number-average molecular weight (Mn) = 15,600, weight-average molecular weight (Mw) = 36,500, peak molecular weight (Mp) = 30,400, Mw/Mn = 2.3, softening temperature (Tm) = 122° C., glass transition temperature (Tg) = 57° C.] | 120 g |
| anionic surfactant (Neogen RK from Dai-ichi Kogyo Seiyaku Co., Ltd.) | 0.6 g |

After the preceding had been mixed, dissolution was carried out by stirring for 12 hours.

4.0 g of N,N-dimethylaminoethanol was then added and stirring was performed at 4,000 rpm using a T. K. Robomix ultrahigh-speed stirrer (PRIMIX Corporation).

360 g of deionized water was additionally added at a rate of 1 g/min to bring about the precipitation of resin microparticles. This was followed by dispersion for about 1 hour using a Nanomizer high-pressure impact-type disperser (Yoshida Kikai Co., Ltd.) and then removal of the tetrahydrofuran using an evaporator to obtain amorphous resin microparticle 5 and its dispersion.

The 50% particle diameter on a volume basis (d50) of amorphous resin microparticle 5 was measured using a dynamic light scattering particle size distribution analyzer (Nanotrac, from Nikkiso Co., Ltd.) at 0.15 μm.

<Production of Crystalline Resin Microparticle 1>

| | |
|---|---|
| tetrahydrofuran (Wako Pure Chemical Industries, Ltd.) | 200 g |
| crystalline polyester A [composition (molar ratio) [1,9-nonanediol:sebacic acid = 100:100], number-average molecular weight (Mn) = 5,500, weight-average molecular weight (Mw) = 15,500, peak molecular weight (Mp) = 11,400, Mw/Mn = 2.8, melting point = 72° C., onset temperature of crystal melting peak = 69° C., acid value = 13 mg KOH/g] | 120 g |
| anionic surfactant (Neogen RK from Dai-ichi Kogyo Seiyaku Co., Ltd.) | 0.6 g |

After the preceding had been mixed, dissolution was carried out by heating to 50° C. and stirring for 3 hours.

2.7 g of N,N-dimethylaminoethanol was then added and stirring was performed at 4,000 rpm using a T. K. Robomix ultrahigh-speed stirrer (PRIMIX Corporation).

360 g of deionized water was additionally added at a rate of 1 g/min to bring about the precipitation of resin microparticles. This was followed by removal of the tetrahydrofuran using an evaporator to obtain crystalline resin microparticle 1 and its dispersion.

The 90% particle diameter on a volume basis (d90) of crystalline resin microparticle 1 was measured using a dynamic light scattering particle size distribution analyzer (Nanotrac, from Nikkiso Co., Ltd.) at 0.30 μm.

<Production of Crystalline Resin Microparticle 2>

A crystalline resin microparticle 2 and its dispersion were obtained proceeding as in Production of Crystalline resin microparticle 1, but changing the crystalline polyester A to a crystalline polyester B [composition (molar ratio) [1,6-hexanediol:sebacic acid=100:100], Mn=4,400, Mw=11,300, Mw/Mn=2.5, melting point=68° C., onset temperature of crystal melting peak=65° C., acid value=12 mg KOH/g]. The 90% particle diameter on a volume basis (d90) of the obtained crystalline resin microparticle 2 was 0.20 μm.

<Production of Crystalline Resin Microparticle 3>

A crystalline resin microparticle 3 and its dispersion were obtained proceeding as in Production of Crystalline resin microparticle 1, but changing the crystalline polyester A to a crystalline polyester C [composition (molar ratio) [1,12-dodecanediol:sebacic acid=100:100], Mn=3,500, Mw=10,300, Mw/Mn=2.9, melting point=87° C., onset temperature of crystal melting peak=84° C., acid value=12 mg KOH/g]. The 90% particle diameter on a volume basis (d90) of the obtained crystalline resin microparticle 3 was 0.32 μm.

<Production of Crystalline Resin Microparticle 4>

A crystalline resin microparticle 4 and its dispersion were obtained proceeding as in Production of Crystalline resin microparticle 1, but in this case the stirring at 4,000 rpm using the T. K. Robomix ultrahigh-speed stirrer (PRIMIX Corporation) was followed by dispersion for about 1 hour using a Nanomizer high-pressure impact-type disperser (Yoshida Kikai Co., Ltd.). The 90% particle diameter on a volume basis (d90) of the obtained crystalline resin microparticle 4 was 0.15 μm.

<Production of Crystalline Resin Microparticle 5>

A crystalline resin microparticle 5 and its dispersion were obtained proceeding as in Production of Crystalline resin microparticle 1, but changing the 2.7 g of N,N-dimethylaminoethanol to 2.0 g. The 90% particle diameter on a volume basis (d90) of the obtained crystalline resin microparticle 5 was 0.45 μm.

<Production of Crystalline Resin Microparticle 6>

A crystalline resin microparticle 6 and its dispersion were obtained proceeding as in Production of Crystalline resin microparticle 1, but changing the 2.7 g of N,N-dimethylaminoethanol to 1.3 g. The 90% particle diameter on a volume basis (d90) of the obtained crystalline resin microparticle 6 was 0.75 μm.

<Production of Crystalline Resin Microparticle 7>

| | |
|---|---|
| toluene (Wako Pure Chemical Industries Ltd.) | 200 g |
| crystalline acrylic resin A [composition (molar ratio) [behenyl acrylate: 100], number-average molecular weight (Mn) = 10,500, weight-average molecular weight (Mw) = 32,500, peak molecular weight (Mp) = 27,400, Mw/Mn = 3.2, melting point = 60° C., onset temperature of crystal melting peak = 56° C.] | 120 g |
| anionic surfactant (Neogen RK from Dai-ichi Kogyo Seiyaku Co., Ltd.) | 6 g |

After the preceding had been mixed, dissolution was carried out by heating to 50° C. and stirring for 3 hours.

Stirring was then performed at 4,000 rpm using a T. K. Robomix ultrahigh-speed stirrer (PRIMIX Corporation).

360 g of deionized water was additionally added at a rate of 10 g/min to bring about the precipitation of resin microparticles. This was followed by dispersion for about 1 hour using a Nanomizer high-pressure impact-type disperser (Yoshida Kikai Co., Ltd.) and then removal of the toluene using an evaporator to obtain crystalline resin microparticle 7 and its dispersion.

The 90% particle diameter on a volume basis (d90) of crystalline resin microparticle 7 was measured using a dynamic light scattering particle size distribution analyzer (Nanotrac, from Nikkiso Co., Ltd.) at 0.32 μm.

<Solubility Test for the Amorphous Resin and Crystalline Resin>

Each of polyester resins A to D, styrene-acrylic resin A, crystalline polyesters A to C, and crystalline acrylic resin A was added in the indicated mass to 1 L of each of the organic solvents shown in Table 1, and in each case the solubility was evaluated after stirring for 12 hours in a 25° C. environment, which is the fusion treatment temperature with organic solvent in the fusion step described below. The results of the evaluations are given in Table 1.

Based on the solubility test for each resin, ethyl acetate, which was a good solvent for the amorphous resins and a poor solvent for the crystalline resins, was used as the organic solvent added in the fusion step during the toner production described below.

(Evaluation Criteria)

A: when 100 g of resin is added, complete dissolution occurs and a transparent solution is obtained B: when 10 g of resin is added, complete dissolution occurs and a transparent solution is obtained; however, with 100 g of the resin, insoluble material is observed and a nonuniform solution is obtained C: when 10 g of resin is added, insoluble material is observed and a non-uniform solution is obtained

TABLE 1

| resin designation | ethyl acetate | toluene | ethanol |
|---|---|---|---|
| polyester resin A | A | A | C |
| polyester resin B | A | A | C |
| polyester resin C | A | A | C |
| polyester resin D | A | A | C |
| styrene-acrylic resin A | A | A | B |
| crystalline polyester A | C | B | C |
| crystalline polyester B | C | B | C |
| crystalline polyester C | C | B | C |
| crystalline acrylic resin A | C | B | C |

<Production of Colorant Microparticles>

| | |
|---|---|
| colorant (cyan pigment, Pigment Blue 15:3 from Dainichiseika Color & Chemicals Mfg. Co., Ltd.) | 10.0 mass parts |
| anionic surfactant (Neogen RK from Dai-ichi Kogyo Seiyaku Co., Ltd.) | 1.5 mass parts |
| deionized water | 88.5 mass parts |

The preceding were mixed with dissolution, and dispersion for about 1 hour was carried out using a Nanomizer high-pressure impact-type disperser (Yoshida Kikai Co., Ltd.) to produce a dispersion of colorant microparticles in which the colorant was dispersed.

The 50% particle diameter on a volume basis (d50) of the obtained colorant microparticles was measured using a dynamic light scattering particle size distribution analyzer (Nanotrac, from Nikkiso Co., Ltd.) and found to be 0.20 μm.

<Production of Release Agent Microparticles>

| | |
|---|---|
| release agent (HNP-51, melting point = 78° C., from Nippon Seiro Co., Ltd.) | 20.0 mass parts |
| anionic surfactant (Neogen RK from Dai-ichi Kogyo Seiyaku Co., Ltd.) | 1.0 mass parts |
| deionized water | 79.0 mass parts |

The preceding were introduced into a stirrer-equipped mixing vessel and then heated to 90° C., and, while circulating to a Clearmix W-Motion (from M Technique Co., Ltd.), a dispersion treatment was run for 60 minutes under the following conditions: rotor outer diameter of 3 cm and clearance of 0.3 mm in the shear agitation section, rotor rotation rate of 19,000 r/min, and screen rotation rate of 19,000 r/min.

A dispersion of release agent microparticles was obtained by subsequently cooling to 40° C. under the following cooling process conditions: rotor rotation rate of 1,000 r/min, screen rotation rate of 0 r/min, cooling rate of 10° C./min.

The 50% particle diameter on a volume basis (d50) of the release agent microparticles was measured using a dynamic light scattering particle size distribution analyzer (Nanotrac, from Nikkiso Co., Ltd.) and found to be 0.15 μm.

Example 1

(Aggregation Step)

| | |
|---|---|
| dispersion of amorphous resin microparticle 1 | 320 mass parts |
| dispersion of crystalline resin microparticle 1 | 80 mass parts |
| dispersion of colorant micro particles | 50 mass parts |
| dispersion of release agent microparticles | 50 mass parts |
| deionized water | 400 mass parts |

These materials were introduced into a round stainless steel flask and, after mixing, an aqueous solution prepared by the dissolution of 2 mass parts of magnesium sulfate in 98 mass parts of deionized water was added and a dispersion treatment was carried out for 10 minutes at 5,000 r/min using a homogenizer (Ultra-Turrax T50 from IKA).

Then, heating was carried out to 58° C. on a heating water bath while suitably adjusting the stirring rate using a stirring blade such that the mixture was stirred. Maintenance at 58° C. for 1 hour was performed to obtain aggregate particles having a volume-average particle diameter of approximately 6.0 μm.

(Fusion Step)

An aqueous solution prepared by the dissolution of 20 mass parts of trisodium citrate in 380 mass parts of deionized water was added to this aggregate particle-containing dispersion; this was followed by the further addition of 2,800 mass parts of deionized water; and cooling to 25° C. while stirring was carried out by introducing water into the water bath.

300 mass parts of ethyl acetate was subsequently added and a fusion treatment was performed at 25° C. for 12 hours while maintaining a sealed state.

This fusion treatment provided well-fused toner particles having a volume-average particle diameter of approximately 5.8 μm and an average circularity of 0.968.

A toner 1 having a volume-average particle diameter of 5.8 μm was subsequently obtained by removing the ethyl acetate using an evaporator, carrying out filtration and solid/liquid separation, then thoroughly washing the filter cake with deionized water, and drying using a vacuum drier. A TEM image of toner 1 is given in the FIGURE.

According to TEM observation of the cross-sectional structure of toner 1, the crystalline resin domains were spherical domains that had retained a microparticulate shape.

The properties of toner 1 and its formulation are given in Table 2.

The designations used in Table 2 in the "diameter" column for the crystalline resin domains are defined as follows.

A: at least 90 number % of the crystalline resin domains have a diameter from 0.05 μm to 0.30 μm B: at least 90 number % of the crystalline resin domains have a diameter from 0.05 μm to 0.50 μm C: at least 90 number % of the crystalline resin domains having a diameter from 0.05 μm to 0.50 μm is not satisfied Example 2

A toner 2 having a volume-average particle diameter of 5.5 μm was obtained proceeding as in Example 1, but changing the dispersion of amorphous resin microparticle 1 from 320 mass parts to 350 mass parts and changing the dispersion of crystalline resin microparticle 1 from 80 mass parts to 50 mass parts.

According to TEM observation of the cross-sectional structure of toner 2, the crystalline resin domains were spherical domains that had retained a micro-particulate shape.

The properties of toner 2 and its formulation are given in Table 2.

Example 3

A toner 3 having a volume-average particle diameter of 5.6 μm was obtained proceeding as in Example 1, but changing the dispersion of amorphous resin micro-particle 1 from 320 mass parts to 280 mass parts and changing the dispersion of crystalline resin micro-particle 1 from 80 mass parts to 120 mass parts.

According to TEM observation of the cross-sectional structure of toner 3, the crystalline resin domains were spherical domains that had retained a micro-particulate shape.

The properties of toner 3 and its formulation are given in Table 2.

Example 4

A toner 4 having a volume-average particle diameter of 5.5 μm was obtained proceeding as in Example 1, but changing the dispersion of amorphous resin microparticle 1 to the dispersion of amorphous resin microparticle 2.

According to TEM observation of the cross-sectional structure of toner 4, the crystalline resin domains were spherical domains that had retained a micro-particulate shape.

The properties of toner 4 and its formulation are given in Table 2.

Example 5

A toner 5 having a volume-average particle diameter of 5.8 μm was obtained proceeding as in Example 1, but changing the dispersion of amorphous resin microparticle 1 to the dispersion of amorphous resin microparticle 3.

According to TEM observation of the cross-sectional structure of toner 5, the crystalline resin domains were spherical domains that had retained a micro-particulate shape.

The properties of toner 5 and its formulation are given in Table 2.

Example 6

A toner 6 having a volume-average particle diameter of 5.8 μm was obtained proceeding as in Example 1, but changing the dispersion of crystalline resin microparticle 1 to the dispersion of crystalline resin microparticle 4.

According to TEM observation of the cross-sectional structure of toner 6, the crystalline resin domains were spherical domains that had retained a micro-particulate shape.

The properties of toner 6 and its formulation are given in Table 2.

Example 7

A toner 7 having a volume-average particle diameter of 5.8 μm was obtained proceeding as in Example 1, but changing the dispersion of crystalline resin microparticle 1 to the dispersion of crystalline resin microparticle 5.

According to TEM observation of the cross-sectional structure of toner 7, the crystalline resin domains were spherical domains that had retained a micro-particulate shape.

The properties of toner 7 and its formulation are given in Table 2.

Example 8

A toner 8 having a volume-average particle diameter of 5.8 μm was obtained proceeding as in Example 1, but changing the dispersion of crystalline resin microparticle 1 to the dispersion of crystalline resin microparticle 2.

According to TEM observation of the cross-sectional structure of toner 8, the crystalline resin domains were spherical domains that had retained a micro-particulate shape.

The properties of toner 8 and its formulation are given in Table 2.

Example 9

A toner 9 having a volume-average particle diameter of 5.8 μm was obtained proceeding as in Example 1, but changing the dispersion of crystalline resin microparticle 1 to the dispersion of crystalline resin microparticle 3.

According to TEM observation of the cross-sectional structure of toner 9, the crystalline resin domains were spherical domains that had retained a micro-particulate shape.

The properties of toner 9 and its formulation are given in Table 2.

Example 10

A toner 10 having a volume-average particle diameter of 6.2 μm was obtained proceeding as in Example 1, but changing the dispersion of amorphous resin microparticle 1 to the dispersion of amorphous resin microparticle 5 and changing the dispersion of crystalline resin microparticle 1 to the dispersion of crystalline resin microparticle 7.

According to TEM observation of the cross-sectional structure of toner 10, the crystalline resin domains were spherical domains that had retained a micro-particulate shape.

The properties of toner 10 and its formulation are given in Table 2.

Comparative Example 1

A toner 11 having a volume-average particle diameter of 5.8 μm was obtained proceeding as in Example 1, but changing the dispersion of crystalline resin microparticle 1 to the dispersion of crystalline resin microparticle 6.

According to TEM observation of the cross-sectional structure of toner 11, the crystalline resin domains were spherical domains that had retained a micro-particulate shape.

The properties of toner 11 and its formulation are given in Table 2.

Comparative Example 2

A toner 12 having a volume-average particle diameter of 5.8 μm was obtained proceeding as in Example 1, but changing the dispersion of amorphous resin microparticle 1 to the dispersion of amorphous resin microparticle 4.

According to TEM observation of the cross-sectional structure of toner 12, the crystalline resin domains were spherical domains that had retained a micro-particulate shape.

The properties of toner 12 and its formulation are given in Table 2.

Comparative Example 3

A toner 13 having a volume-average particle diameter of 6.0 μm was obtained proceeding as in Example 1, but changing the dispersion of amorphous resin microparticle 1 to the dispersion of amorphous resin microparticle 5.

According to TEM observation of the cross-sectional structure of toner 13, the crystalline resin domains were spherical domains that had retained a micro-particulate shape.

The properties of toner 13 and its formulation are given in Table 2.

Comparative Example 4

(Aggregation Step)

| | |
|---|---|
| dispersion of amorphous resin microparticle 1 | 320 mass parts |
| dispersion of crystalline resin microparticle 1 | 80 mass parts |
| dispersion of colorant microparticles | 50 mass parts |
| dispersion of release agent microparticles | 50 mass parts |
| deionized water | 400 mass parts |

These materials were introduced into a round stainless steel flask and, after mixing, an aqueous solution prepared by the dissolution of 2 mass parts of magnesium sulfate in 98 mass parts of deionized water was added and a dispersion treatment was carried out for 10 minutes at 5,000 r/min using a homogenizer (Ultra-Turrax T50 from IKA).

Then, heating was carried out to 58° C. on a heating water bath while suitably adjusting the stirring rate using a stirring blade such that the mixture was stirred. Maintenance at 58° C. for 1 hour was performed to obtain aggregate particles having a volume-average particle diameter of approximately 6.0 μm.

(Fusion Step)

An aqueous solution prepared by the dissolution of 20 mass parts of trisodium citrate in 380 mass parts of deionized water was added to this aggregate particle-containing dispersion, and this was followed by heating to 85° C. while continuing to stir and maintenance for 2 hours in a sealed state.

This fusion treatment provided well-fused toner particles having a volume-average particle diameter of approximately 5.8 μm and an average circularity of 0.975.

The toner particle-containing dispersion was cooled to 25° C. by introducing water into the water bath, and a toner 14 having a volume-average particle diameter of 5.8 μm was obtained by carrying out filtration and solid/liquid separation, then thoroughly washing the filter cake with deionized water, and drying using a vacuum drier.

According to TEM observation of the cross-sectional structure of toner 14, the crystalline resin had not formed domains in the toner particle and was in a compatibilized state with the amorphous resin.

With regard to the results of the DSC measurements, because the crystalline resin was present already compatibilized in the amorphous resin, in the first temperature ramp up the melting endothermic peak was present to a degree that was very faintly detected. In addition, being in an already compatibilized state, there was no change with toner 14 in the melting endothermic peak between the DSC curves in the first temperature ramp up and the second temperature ramp up.

Comparative Example 5

A toner 15 having a volume-average particle diameter of 5.8 μm was obtained proceeding as in Comparative Example 4, but changing the dispersion of amorphous resin microparticle 1 to the dispersion of amorphous resin microparticle 4.

According to TEM observation of the cross-sectional structure of toner 15, the crystalline resin domains were spherical domains that had retained a micro-particulate shape.

The properties of toner 15 and its formulation are given in Table 2.

Comparative Example 6

(Aggregation Step)

| | |
|---|---|
| dispersion of amorphous resin microparticle 1 | 320 mass parts |
| dispersion of crystalline resin micro particle 1 | 80 mass parts |
| dispersion of colorant microparticles | 50 mass parts |
| dispersion of release agent microparticles | 50 mass parts |
| deionized water | 400 mass parts |

These materials were introduced into a round stainless steel flask and, after mixing, an aqueous solution prepared by the dissolution of 2 mass parts of magnesium sulfate in 98 mass parts of deionized water was added and a dispersion treatment was carried out for 10 minutes at 5,000 r/min using a homogenizer (Ultra-Turrax T50 from IKA).

Then, heating was carried out to 58° C. on a heating water bath while suitably adjusting the stirring rate using a stirring blade such that the mixture was stirred. Maintenance at 58° C. for 1 hour was performed to obtain aggregate particles having a volume-average particle diameter of approximately 6.0 μm.

(The Fusion Step)

An aqueous solution prepared by the dissolution of 20 mass parts of trisodium citrate in 380 mass parts of deionized water was added to this aggregate particle-containing dispersion, and this was followed by heating to 85° C. while continuing to stir and maintenance for 2 hours in a sealed state.

This fusion treatment provided well-fused toner particles having a volume-average particle diameter of approximately 5.8 μm and an average circularity of 0.975.

The toner particle-containing dispersion was cooled to 25° C. by introducing water into the water bath. A thermal annealing treatment was additionally performed by reheating to 50° C. and holding for 4 hours.

After this, a toner 16 having a volume-average particle diameter of 5.8 μm was obtained by cooling the toner particle-containing dispersion to 25° C., carrying out filtration•solid/liquid separation, then thoroughly washing the filter cake with deionized water, and drying using a vacuum drier.

According to TEM observation of the cross-sectional structure of toner 16, the crystalline resin was observed to have formed nonspherical domains of needle-shaped crystals in the toner particle. According to observation of the toner with a scanning electron microscope (SEM), fiber-shaped structures, which were crystalline resin domains, were seen at the toner surface.

The properties of toner 16 and its formulation are given in Table 2.

Comparative Example 7

(Aggregation Step)

| | |
|---|---|
| dispersion of amorphous resin microparticle 1 | 320 mass parts |
| dispersion of crystalline resin microparticle 1 | 80 mass parts |
| dispersion of colorant microparticles | 50 mass parts |
| dispersion of release agent microparticles | 50 mass parts |
| deionized water | 400 mass parts |

These materials were introduced into a round stainless steel flask and, after mixing, an aqueous solution prepared by the dissolution of 2 mass parts of magnesium sulfate in 98 mass parts of deionized water was added and a dispersion treatment was carried out for 10 minutes at 5,000 r/min using a homogenizer (Ultra-Turrax T50 from IKA).

Then, heating was carried out to 58° C. on a heating water bath while suitably adjusting the stirring rate using a stirring blade such that the mixture was stirred. Maintenance at 58° C. for 1 hour was performed to obtain aggregate particles having a volume-average particle diameter of approximately 6.0 μm.

(Fusion Step)

An aqueous solution prepared by the dissolution of 20 mass parts of trisodium citrate in 380 mass parts of deionized water was added to this aggregate particle-containing dispersion, and this was followed by heating to 85° C. while continuing to stir and maintenance for 2 hours in a sealed state.

This fusion treatment provided well-fused toner particles having a volume-average particle diameter of approximately 5.8 μm and an average circularity of 0.975.

The toner particle-containing dispersion was cooled to 25° C. by introducing water into the water bath. A thermal annealing treatment was additionally performed by reheating to 50° C. and holding for 20 hours.

After this, a toner 17 having a volume-average particle diameter of 5.8 μm was obtained by cooling the toner particle-containing dispersion to 25° C., carrying out filtration and solid/liquid separation, then thoroughly washing the filter cake with deionized water, and drying using a vacuum drier.

According to TEM observation of the cross-sectional structure of toner 17, the crystalline resin in the toner particle was observed to have grown even larger than in the aforementioned toner 16 and to have formed nonspherical domains of needle-shaped crystals. According to observation of the toner with a scanning electron microscope (SEM), fiber-shaped structures, which were crystalline resin domains, were seen at the toner surface.

The properties of toner 17 and its formulation are given in Table 2.

Comparative Example 8

| | |
|---|---|
| polyester resin A | 80 mass parts |
| crystalline polyester A | 20 mass parts |
| colorant (cyan pigment, Pigment Blue 15:3 from Dainichiseika Color & Chemicals Mfg. Co., Ltd.) | 5 mass parts |
| release agent (HNP-51, melting point = 78° C., from Nippon Seiro Co., Ltd.) | 5 mass parts |

These starting materials were preliminarily mixed with a Henschel mixer and were then subjected to a kneading treatment for 2 hours using a twin-screw kneading extruder (PCM-30 from Ikegai Ironworks Corporation) set to 130° C. and 200 rpm.

The obtained kneaded material was cooled and coarsely pulverized using a cutter mill; the resulting coarsely pulverized material was subsequently finely pulverized using a Turbo Mill T-250 (Turbo Kogyo Co., Ltd.); and classification was carried out using a Coanda effect-based multi-grade classifier to obtain a toner 18 having a volume-average particle diameter of 5.8 μm.

The properties of toner 18 and its formulation are given in Table 2.

With regard to the results of the DSC measurements, because the crystalline resin was present already compatibilized in the amorphous resin, in the first temperature ramp up the melting endothermic peak was present to a degree that was very faintly detected. In addition, being in an already compatibilized state, there was no change with toner 18 in the melting endothermic peak between the DSC curves in the first temperature ramp up and the second temperature ramp up.

Comparative Example 9

| | |
|---|---|
| polyester resin A | 80 mass parts |
| crystalline polyester A | 20 mass parts |
| colorant (cyan pigment, Pigment Blue 15:3 from Dainichiseika Color & Chemicals Mfg. Co., Ltd.) | 5 mass parts |
| release agent (HNP-51, melting point = 78° C., from Nippon Seiro Co., Ltd.) | 5 mass parts |

These starting materials were preliminarily mixed with a Henschel mixer and were then subjected to a kneading treatment for 30 minutes using a twin-screw kneading extruder (PCM-30 from Ikegai Ironworks Corporation) set to 90° C. and 150 rpm; these conditions involved a lower temperature, a lower rotation rate, and a shorter treatment time than in Comparative Example 8.

The obtained kneaded material was cooled and coarsely pulverized using a cutter mill; the resulting coarsely pulverized material was subsequently finely pulverized using a Turbo Mill T-250 (Turbo Kogyo Co., Ltd.); and classification was carried out using a Coanda effect-based multi-grade classifier to obtain a toner 19 having a volume-average particle diameter of 5.8 μm.

TEM observation of the cross-sectional structure of toner 19 showed that complete compatibilization had not occurred and that the crystalline resin had in part formed domains.

In addition, the domains formed in the toner particle by the crystalline resin were observed to be nonspherical needle-shaped crystals. According to observation of the toner with a scanning electron microscope (SEM), fiber-shaped structures, which were crystalline resin domains, were seen at the toner surface.

The properties of toner 19 and its formulation are given in Table 2.

Comparative Example 10

| | |
|---|---|
| polyester resin D | 80 mass parts |
| crystalline polyester A | 20 mass parts |
| colorant (cyan pigment, Pigment Blue 15:3 from Dainichiseika Color & Chemicals Mfg. Co., Ltd.) | 5 mass parts |
| release agent (HNP-51, melting point = 78° C., from Nippon Seiro Co., Ltd.) | 5 mass parts |

These starting materials were preliminarily mixed with a Henschel mixer and were then subjected to a kneading treatment for 2 hours using a twin-screw kneading extruder (PCM-30 from Ikegai Ironworks Corporation) set to 130° C. and 200 rpm.

The obtained kneaded material was cooled and coarsely pulverized using a cutter mill; the resulting coarsely pulverized material was subsequently finely pulverized using a Turbo Mill T-250 (Turbo Kogyo Co., Ltd.); and classification was carried out using a Coanda effect-based multi-grade classifier to obtain a toner 20 having a volume-average particle diameter of 5.8 μm.

According to TEM observation of the cross-sectional structure of toner 20, the crystalline resin was observed to have formed relatively spherical domains in the toner particle.

The properties of toner 20 and its formulation are given in Table 2.

TABLE 2

| | | | amorphous resin | | crystalline resin | | | | amount of | | crystalline resin domains | |
|---|---|---|---|---|---|---|---|---|---|---|---|---|
| | toner particle | organic solvent | amorphous resin | SP value | crystalline resin | SP value | ΔSP value | onset temperature of the crystal melting peak (° C.) | addition of the crystalline resin (mass parts) | compatibility DSC (Wt/Wr × Z/100) | diameter | SF1 |
| Example 1 | toner 1 | ethyl acetate | polyester resin A | 11.14 | crystalline polyester A | 9.63 | 1.51 | 69 | 20 | 0.21 | A | 112 |

TABLE 2-continued

| | | | amorphous resin | | crystalline resin | | | | amount of | | | |
|---|---|---|---|---|---|---|---|---|---|---|---|---|
| | toner particle | organic solvent | amorphous resin | SP value | crystalline resin | SP value | ΔSP value | onset temperature of the crystal melting peak (° C.) | addition of the crystalline resin (mass parts) | compatibility DSC (Wt/Wr × Z/100) | crystalline resin domains diameter | SF1 |
| Example 2 | toner 2 | ethyl acetate | polyester resin A | 11.14 | crystalline polyester A | 9.63 | 1.51 | 69 | 12.5 | 0.00 | A | 112 |
| Example 3 | toner 3 | ethyl acetate | polyester resin A | 11.14 | crystalline polyester A | 9.63 | 1.51 | 69 | 30 | 0.44 | A | 112 |
| Example 4 | toner 4 | ethyl acetate | polyester resin B | 11.21 | crystalline polyester A | 9.63 | 1.58 | 69 | 20 | 0.35 | A | 112 |
| Example 5 | toner 5 | ethyl acetate | polyester resin C | 11.25 | crystalline polyester A | 9.63 | 1.62 | 69 | 20 | 0.45 | A | 112 |
| Example 6 | toner 6 | ethyl acetate | polyester resin A | 11.14 | crystalline polyester A | 9.63 | 1.51 | 69 | 20 | 0.21 | A | 112 |
| Example 7 | toner 7 | ethyl acetate | polyester resin A | 11.14 | crystalline polyester A | 9.63 | 1.51 | 69 | 20 | 0.21 | B | 112 |
| Example 8 | toner 8 | ethyl acetate | polyester resin A | 11.14 | crystalline polyester B | 9.81 | 1.33 | 65 | 20 | 0.12 | A | 120 |
| Example 9 | toner 9 | ethyl acetate | polyester resin A | 11.14 | crystalline polyester C | 9.49 | 1.65 | 84 | 20 | 0.32 | B | 125 |
| Example 10 | toner 10 | ethyl acetate | styrene-acrylic resin A | 9.97 | crystalline acrylic resin A | 8.94 | 1.03 | 56 | 20 | 0.33 | B | 108 |
| Comparative Example 1 | toner 11 | ethyl acetate | polyester resin A | 11.14 | crystalline polyester A | 9.63 | 1.51 | 69 | 20 | 0.21 | C | 112 |
| Comparative Example 2 | toner 12 | ethyl acetate | polyester resin D | 11.37 | crystalline polyester A | 9.63 | 1.74 | 69 | 20 | 0.78 | A | 112 |
| Comparative Example 3 | toner 13 | ethyl acetate | styrene-acrylic resin A | 9.97 | crystalline polyester A | 9.63 | 0.34 | 69 | 20 | 0.98 | A | 112 |
| Comparative Example 4 | toner 14 | — | polyester resin A | 11.14 | crystalline polyester A | 9.63 | 1.51 | 69 | 20 | — | domains indistinct due to compatibilization | |
| Comparative Example 5 | toner 15 | — | polyester resin D | 11.37 | crystalline polyester A | 9.63 | 1.74 | 69 | 20 | 0.81 | B | 118 |
| Comparative Example 6 | toner 16 | — | polyester resin A | 11.14 | crystalline polyester A | 9.63 | 1.51 | 69 | 20 | 0.19 | B | 261 |
| Comparative Example 7 | toner 17 | — | polyester resin A | 11.14 | crystalline polyester A | 9.63 | 1.51 | 69 | 20 | 0.19 | C | 523 |
| Comparative Example 8 | toner 18 | — | polyester resin A | 11.14 | crystalline polyester A | 9.63 | 1.51 | 69 | 20 | — | domains indistinct due to compatibilization | |
| Comparative Example 9 | toner 19 | — | polyester resin A | 11.14 | crystalline polyester A | 9.63 | 1.51 | 69 | 20 | 0.44 | B | 255 |
| Comparative Example 10 | toner 20 | — | polyester resin D | 11.37 | crystalline polyester A | 9.63 | 1.74 | 69 | 20 | 0.85 | B | 133 |

The following evaluations were performed using toners 1 to 20. The results are given in Table 3.

(Evaluation of the Storability)

An external additive-bearing toner was produced by dry mixing the following using a Henschel mixer (Mitsui Mining Co., Ltd.) into 100 mass parts of the toner: 1.8 mass parts of silica microparticles that had a specific surface area measured by the BET method of 200 $m^2/g$ and that had been hydrophobically treated with a silicone oil.

The toner was subsequently held at quiescence for 3 days in a constant-temperature, constant-humidity chamber; it was then sieved for 300 seconds at a shaking amplitude of 1 mm using a sieve with an aperture of 75 μm; and the amount of toner remaining on the sieve was evaluated according to the criteria given below. The results of the evaluation are given in Table 3.

(Evaluation Criteria)

A: the amount of toner remaining on the sieve is not more than 10% when the sieving treatment is carried out after holding at quiescence for 3 days in a constant-temperature, constant-humidity chamber at a temperature of 55° C. and a humidity of 10% RH B: the amount of toner remaining on the sieve exceeds 10% when the sieving treatment is carried out after holding at quiescence for 3 days in a constant-temperature, constant-humidity chamber at a temperature of 55° C. and a humidity of 10% RH, but the amount of toner remaining on the sieve is not more than 10% when the sieving treatment is carried out after holding at quiescence for 3 days in a constant-temperature, constant-humidity chamber at a temperature of 50° C. and a humidity of 10% RH C: the amount of toner remaining on the sieve exceeds 10% when the sieving treatment is carried out after holding at quiescence for 3 days in a constant-temperature, constant-humidity chamber at a temperature of 50° C. and a humidity of 10% RH (Evaluation of the Low-Temperature Fixability)

An external additive-bearing toner was produced by dry mixing the following using a Henschel mixer (Mitsui Mining Co., Ltd.) into 100 mass parts of the toner: 1.8 mass parts of silica microparticles that had a specific surface area measured by the BET method of 200 $m^2/g$ and that had been hydrophobically treated with a silicone oil.

A two-component developer was prepared by mixing the toner with a ferrite carrier (average particle diameter=42

μm) that had been surface-coated with a silicone resin, so as to provide a toner concentration of 8 mass %.

This two-component developer was filled into a commercial full-color digital copier (CLC1100 from Canon, Inc.), and an unfixed toner image (0.6 mg/cm$^2$) was formed on an image-receiving paper (64 g/m$^2$).

The fixing unit was removed from a commercial full-color digital copier (imageRUNNER ADVANCE C5051 from Canon, Inc.) and was modified to make the fixation temperature adjustable, and this was used to carry out a fixing test on the unfixed image. The unfixed image was fixed under normal temperature and normal humidity with the process speed set to 246 mm/second, and the appearance was then visually inspected. The results of the evaluation are given in Table 3.

(Evaluation Criteria)

5: fixing can be carried out in the temperature region less than or equal to 120° C.

4: fixing can be carried out in the temperature region greater than 120° C. and up to and including 125° C.

3: fixing can be carried out in the temperature region greater than 125° C. and up to and including 130° C.

2: fixing can be carried out in the temperature region greater than 130° C. and up to and including 140° C.

1: the region in which fixing can be carried out is only the temperature region above 140° C.

(Evaluation of the Charging Performance)

An external additive-bearing toner was produced by dry mixing the following using a Henschel mixer (Mitsui Mining Co., Ltd.) into 100 mass parts of the toner: 1.8 mass parts of silica microparticles that had a specific surface area measured by the BET method of 200 m$^2$/g and that had been hydrophobically treated with a silicone oil.

A two-component developer was prepared by mixing the toner with a ferrite carrier (average particle diameter=42 μm) that had been surface-coated with a silicone resin, so as to provide a toner concentration of 8 mass %.

Here, the amount of charge on the toner was measured using an Espart Analyzer from Hosokawa Micron Corporation. The Espart Analyzer is an instrument that measures the particle diameter and amount of charge by introducing the sample particles into a detection section (measurement section) in which both an electrical field and an acoustic field are formed at the same time and measuring the velocity of particle motion by the laser doppler technique. The sample particle that has entered the measurement section of the instrument is subjected to the effects of the acoustic field and electrical field and falls while undergoing deflection in the horizontal direction, and the beat frequency of the velocity in this horizontal direction is counted. The count value is input by interrupt to a computer, and the particle diameter distribution or the charge distribution per unit particle diameter is displayed on the computer screen in real time. Once the amount of charge on a prescribed number has been measured, the screen is terminated and subsequent to this, for example, the three-dimensional distribution of amount of charge and particle diameter, the charge distribution by particle diameter, the average amount of charge (coulomb/weight), and so forth, is displayed on the screen.

The amount of charge on the toner was measured by introducing the aforementioned two-component developer as the sample particles into the measurement section of the Espart Analyzer.

After the initial triboelectric charge quantity on the toner had been measured by this procedure, the two-component developer was held at quiescence for 1 week in a constant-temperature, constant-humidity chamber (temperature=30° C., humidity=80% RH) and the triboelectric charge quantity was then re-measured.

The triboelectric charge quantity retention rate was calculated by substituting the measurement results into the following formula and was evaluated using the criteria given below. The results of the evaluation are given in Table 3.

formula: triboelectric charge quantity retention rate (%) for the toner=[triboelectric charge quantity for the toner after 1 week]/[initial triboelectric charge quantity for the toner]×100

(Evaluation Criteria)

A: the triboelectric charge quantity retention rate for the toner is at least 80%

B: the triboelectric charge quantity retention rate for the toner is from at least 60% to less than 80%

C: the triboelectric charge quantity retention rate for the toner is less than 60%

TABLE 3

| | toner | storability | low-temperature fixability | charging performance |
|---|---|---|---|---|
| Example 1 | toner 1 | A | 5 | A |
| Example 2 | toner 2 | A | 3 | A |
| Example 3 | toner 3 | A | 5 | B |
| Example 4 | toner 4 | A | 4 | A |
| Example 5 | toner 5 | A | 3 | A |
| Example 6 | toner 6 | A | 5 | A |
| Example 7 | toner 7 | A | 5 | A |
| Example 8 | toner 8 | A | 5 | A |
| Example 9 | toner 9 | A | 4 | A |
| Example 10 | toner 10 | A | 3 | A |
| Comparative Example 1 | toner 11 | A | 5 | C |
| Comparative Example 2 | toner 12 | A | 1 | A |
| Comparative Example 3 | toner 13 | A | 1 | A |
| Comparative Example 4 | toner 14 | C | 5 | C |
| Comparative Example 5 | toner 15 | A | 1 | A |
| Comparative Example 6 | toner 16 | A | 5 | C |
| Comparative Example 7 | toner 17 | A | 5 | C |
| Comparative Example 8 | toner 18 | C | 5 | C |
| Comparative Example 9 | toner 19 | A | 5 | C |
| Comparative Example 10 | toner 20 | A | 1 | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-249319, filed Dec. 9, 2014, and Japanese Patent Application No. 2015-233845, filed Nov. 30, 2015, which are hereby incorporated by reference herein in their entirety.

The invention claimed is:

1. A method of producing a toner comprising a toner particle comprising a crystalline polyester resin and an amorphous polyester resin, the production method comprising:

an aggregation step of obtaining aggregate particles by mixing an amorphous polyester resin microparticle dispersion comprising dispersed microparticles of the amorphous polyester resin, with a crystalline polyester resin microparticle dispersion comprising dispersed microparticles of the crystalline polyester resin, and carrying out an aggregation in which microparticles including the amorphous polyester resin microparticles and the crystalline polyester resin microparticles are aggregated; and a fusion step of carrying out a fusion treatment on the aggregate particles by adding at a fusion treatment temperature an organic solvent that, at the fusion treatment temperature, is a good solvent for the amorphous polyester resin and a poor solvent for the crystalline polyester resin, wherein the fusion treatment temperature is a temperature that is not larger than the onset temperature of the crystal melting peak of the crystalline polyester resin as measured with a differential scanning calorimeter (DSC), the crystalline polyester resin is obtained by condensation polymerization of a diol component containing at least one compound selected from the group consisting of 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, and a dicarboxylic acid component containing at least one compound selected from the group consisting of suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, the amorphous polyester resin is obtained by condensation polymerization of a diol component that is a bisphenol derivative represented by formula (1)

(1)

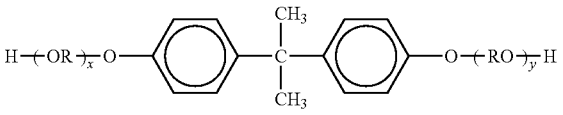

(where R represents an ethylene group or propylene group, x and y are each an integer equal to or greater than 1, and the average value of x+y is from 2 to 10), and a carboxylic acid component containing at least one compound selected from the group consisting of fumaric acid, maleic acid, maleic anhydride, phthalic acid, terephthalic acid, trimellitic acid, and pyromellitic acid, the toner particle has a matrix-domain structure in which domains of the crystalline polyester resin are present in a matrix of the amorphous polyester resin, at least 90 number % of the crystalline polyester resin domains having a diameter from 0.05 μm to 0.50 μm, SF1 for the crystalline polyester resin domains is from 100 to 130 as calculated by $SF1=(ML^2/A)\times(\pi/4)\times100$ where ML represents the absolute maximum length of the crystalline polyester resin domains and A represents a projected area of the crystalline polyester resin domains, and the toner satisfies $0.00\leq(Wt2/Wt1)\leq0.50$ where Wt1 represents heat of fusion (J/g) originating with the crystalline polyester resin during a first temperature ramp up in measurement on the toner using a differential scanning calorimeter (DSC), and Wt2 represents heat of fusion (J/g) originating with the crystalline polyester resin during a second temperature ramp up in measurement on the toner using a differential scanning calorimeter (DSC).

2. The method of producing toner according to claim 1, wherein the clystalline polyester resin is obtained by condensation polymerization of a diol component containing at least one compound selected from the group consisting of 1, 9-nonanediol, 1, 12-dodecanediol and a dicarboxylic acid component containing sebacic acid.

3. The method of producing toner according to claim 1, wherein the toner particle contains from 10 to 40 mass % of the crystalline resin.

4. The method of producing toner according to claim 1, wherein the melting point of the crystalline resin is from 50° C. to 100° C.

* * * * *